US008042898B2

(12) United States Patent
Shibata

(10) Patent No.: US 8,042,898 B2
(45) Date of Patent: Oct. 25, 2011

(54) INKJET RECORDING APPARATUS AND METHOD

(75) Inventor: Hiroshi Shibata, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 388 days.

(21) Appl. No.: 12/414,271

(22) Filed: Mar. 30, 2009

(65) Prior Publication Data

US 2009/0244131 A1 Oct. 1, 2009

(30) Foreign Application Priority Data

Mar. 31, 2008 (JP) ..... 2008-093094

(51) Int. Cl.
*B41J 29/38* (2006.01)

(52) U.S. Cl. ..... 347/9; 347/5; 347/6; 347/7; 347/10; 347/11; 347/12; 347/13; 347/14; 347/15; 347/17

(58) Field of Classification Search ..... 347/5–7, 347/9–15, 17
See application file for complete search history.

(56) References Cited

U.S. PATENT DOCUMENTS 4,514,742 A * 4/1985 Suga et al. ..... 347/85
6,252,616 B1 * 6/2001 Okazaki et al. ..... 347/65
6,378,971 B1 * 4/2002 Tamura et al. ..... 347/7
6,851,779 B2 * 2/2005 Okazaki et al. ..... 347/11
7,380,925 B2 * 6/2008 Katayama et al. ..... 347/86
7,748,811 B2 * 7/2010 Yamashita ..... 347/11

FOREIGN PATENT DOCUMENTS

JP 2007-245452 A 9/2007
JP 2007-245568 A 9/2007

* cited by examiner

*Primary Examiner* — Ryan Lepisto
*Assistant Examiner* — Guy Anderson
(74) *Attorney, Agent, or Firm* — Birch, Stewart, Kolasch & Birch, LLP

(57) ABSTRACT

The inkjet recording apparatus includes: an inkjet recording head which includes a nozzle through which liquid is ejected; a pressure regulating unit which includes a liquid chamber that communicates with the nozzle and a gas chamber that is partitioned from the liquid chamber by a flexible film; and a liquid chamber pressure controlling device which controls a pressure of the liquid chamber to a predetermined negative pressure when carrying out back pressure control in which back pressure is applied to the liquid inside the nozzle, wherein: the flexible film causes change in the pressure of the liquid chamber when the liquid is supplied for at least a predetermined supply amount to the liquid chamber in a state where the gas chamber is open to air; and the liquid chamber pressure controlling device carries out the back pressure control after controlling the pressure of the liquid chamber to a predetermined value of positive pressure by supplying the liquid of at least the predetermined supply amount to the liquid chamber.

5 Claims, 14 Drawing Sheets

INKJET RECORDING APPARATUS AND METHOD

BACKGROUND OF THE INVENTION

1. Field of the Invention

The present invention relates to an inkjet recording apparatus and an inkjet recording method, and particularly relates to an inkjet recording apparatus and an inkjet recording method capable of stably carrying out back pressure control in which back pressure is applied to a liquid inside a nozzle of an inkjet recording head.

2. Description of the Related Art

Japanese Patent Application Publication No. 2007-245568 discloses that a recording head is provided with a pressure regulating chamber container that regulates pressure inside a sub-tank of the recording head, and is further provided with an elastic deformation member for regulating a pressure of a gas inside this pressure regulating chamber container, and forming an indentation or a flat surface for example in a portion of the elastic deformation member enables deformation to be caused from a specific location so as to stabilize a negative pressure characteristic of the pressure regulating chamber.

However, it is necessary to devise a shape of the elastic deformation member, and unevenness in dimensional accuracy during production of the elastic deformation member may occur easily, which makes it difficult to control the modulus of elasticity. Therefore there is a risk that it may not be possible to stabilize the negative pressure characteristics of the pressure regulating chamber.

Moreover, compactness is difficult to achieve since it is necessary to arrange the elastic deformation member directly above the recording head. Furthermore, since the pressure of the gas inside the pressure regulating chamber container is regulated by causing deformation of the elastic deformation member from a specific location, there is a risk that the durability of the elastic deformation member is reduced.

Japanese Patent Application Publication No. 2007-245452 discloses that in back pressure control of a recording head, by supplying and discharging ink between an inside of a tightly sealable intermediate tank and an ink tank, the pressure of a gas inside the intermediate tank is controlled, thereby ensuring a uniform negative pressure inside the nozzles of the recording head.

However, since the ink and the gas are in direct contact inside the intermediate tank, an ink degassing effect cannot be maintained and there is a risk that the ejection characteristics of the recording head will deteriorate. Furthermore, since no damping function is provided to damp pressure fluctuations in the ink when pressure fluctuations of the gas inside the intermediate tank are transmitted to the ink, time is required for the pressure fluctuations of the ink to settle, and there is a risk that back pressure control of the recording head is not stable.

SUMMARY OF THE INVENTION

The present invention has been contrived in view of these circumstances, and it is an object therein to provide an inkjet recording apparatus and an inkjet recording method capable of stably carrying out back pressure control in which back pressure is applied to a liquid inside a nozzle of an inkjet recording head.

In order to attain the aforementioned object, the present invention is directed to an inkjet recording apparatus, comprising: an inkjet recording head which includes a nozzle through which liquid is ejected; a pressure regulating unit which includes a liquid chamber that communicates with the nozzle and a gas chamber that is partitioned from the liquid chamber by a flexible film; and a liquid chamber pressure controlling device which controls a pressure of the liquid chamber to a predetermined negative pressure when carrying out back pressure control in which back pressure is applied to the liquid inside the nozzle, wherein: the flexible film causes change in the pressure of the liquid chamber when the liquid is supplied for at least a predetermined supply amount to the liquid chamber in a state where the gas chamber is open to air; and the liquid chamber pressure controlling device carries out the back pressure control after controlling the pressure of the liquid chamber to a predetermined value of positive pressure by supplying the liquid of at least the predetermined supply amount to the liquid chamber.

According to this aspect of the present invention, the back pressure control is carried out after the pressure of the liquid chamber of the pressure regulating unit has been controlled to a predetermined value of positive pressure, and therefore sudden pressure changes in the liquid chamber due to bulging of the flexible film of the pressure regulating unit during the back pressure control can be mitigated and stable back pressure control can be carried out. That is, the control of back pressure is possible at a region (slackness region) where there is little influence of the flexible film.

Moreover, it is not necessary to carry out selections of devised shapes and materials for the flexible film, and therefore it becomes unnecessary to manage the thickness and types of flexible film, which enables reduced costs to be achieved for the flexible film.

Further, a damping force can be applied to pressure fluctuations using the flexible film, and therefore it is possible to suppress pressure fluctuations in a short time.

Furthermore, the liquid chamber and the gas chamber are partitioned by the flexible film, and therefore the degassed state of the ink can be maintained, which stabilizes ejection.

Preferably, the liquid chamber pressure controlling device controls the pressure of the liquid chamber to the predetermined value of positive pressure that is obtained from the predetermined negative pressure to be controlled as the pressure of the liquid chamber during the back pressure control, elastic characteristics of the flexible film, and elastic characteristics of the gas chamber.

According to this aspect of the present invention, sudden pressure changes in the liquid chamber due to bulging of the flexible film of the pressure regulating unit during the back pressure control can be very reliably mitigated and stable back pressure control can be carried out.

Preferably, the recording head has a liquid supply port through which the liquid is supplied to the recording head, and a liquid discharge port through which the liquid supplied through the liquid supply port and flowing through the recording head is discharged; the pressure regulating unit includes a first pressure regulating unit in which the liquid chamber communicates with the liquid supply port, and a second pressure regulating unit in which the liquid chamber communicates with the liquid discharge port; and the liquid chamber pressure controlling device causes the liquid supplied from the liquid supply port to be discharged from the liquid discharge port through the recording head by providing a pressure difference between the liquid chamber of the first pressure regulating unit and the liquid chamber of the second pressure regulating unit.

According to this aspect of the present invention, in a case where the back pressure control is carried out by the first pressure regulating unit and the second pressure regulating unit, sudden pressure changes in the liquid chamber due to bulging of the flexible films of the first pressure regulating unit and the second pressure regulating unit during the back pressure control can be mitigated and stable back pressure control can be carried out.

Preferably, the inkjet recording apparatus further comprises an auxiliary gas chamber which communicates with the gas chamber.

According to this aspect of the present invention, even in a case in which the ink ejection amount from the recording head is large and the ink supply/discharge amount of the liquid chamber is large, the amount of pressure change in the liquid chambers can be kept small and the back pressure control can be carried out stably. Moreover, compactness around the head can be achieved. Furthermore, since the capacity of the gas chamber of the pressure regulating unit can be kept small, the time of pressure application can be shortened when applying pressure to achieve the predetermined positive pressure value for the liquid chamber, and the durability of the flexible film is also improved.

In order to attain the aforementioned object, the present invention is also directed to an inkjet recording method of carrying out back pressure control by applying back pressure to liquid inside a nozzle in an inkjet recording head by controlling a pressure of a liquid chamber of a pressure regulating unit provided with a liquid chamber that is arranged in the inkjet recording head and communicates with the nozzle through which the liquid is ejected, and a gas chamber partitioned from the liquid chamber by a flexible film, the flexible film causing change in the pressure of the liquid chamber when the liquid is supplied for at least a predetermined supply amount to the liquid chamber in a state where the gas chamber is open to air, the method comprising the steps of: controlling the pressure of the liquid chamber to a predetermined value of positive pressure by supplying the liquid of at least the predetermined supply amount greater to the liquid chamber; and then carrying out the back pressure control.

According to the present invention, back pressure control, in which back pressure is applied to liquid inside a nozzle of an inkjet recording head, can be carried out stably.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

General Composition of Inkjet Recording Apparatus

Figure 1:
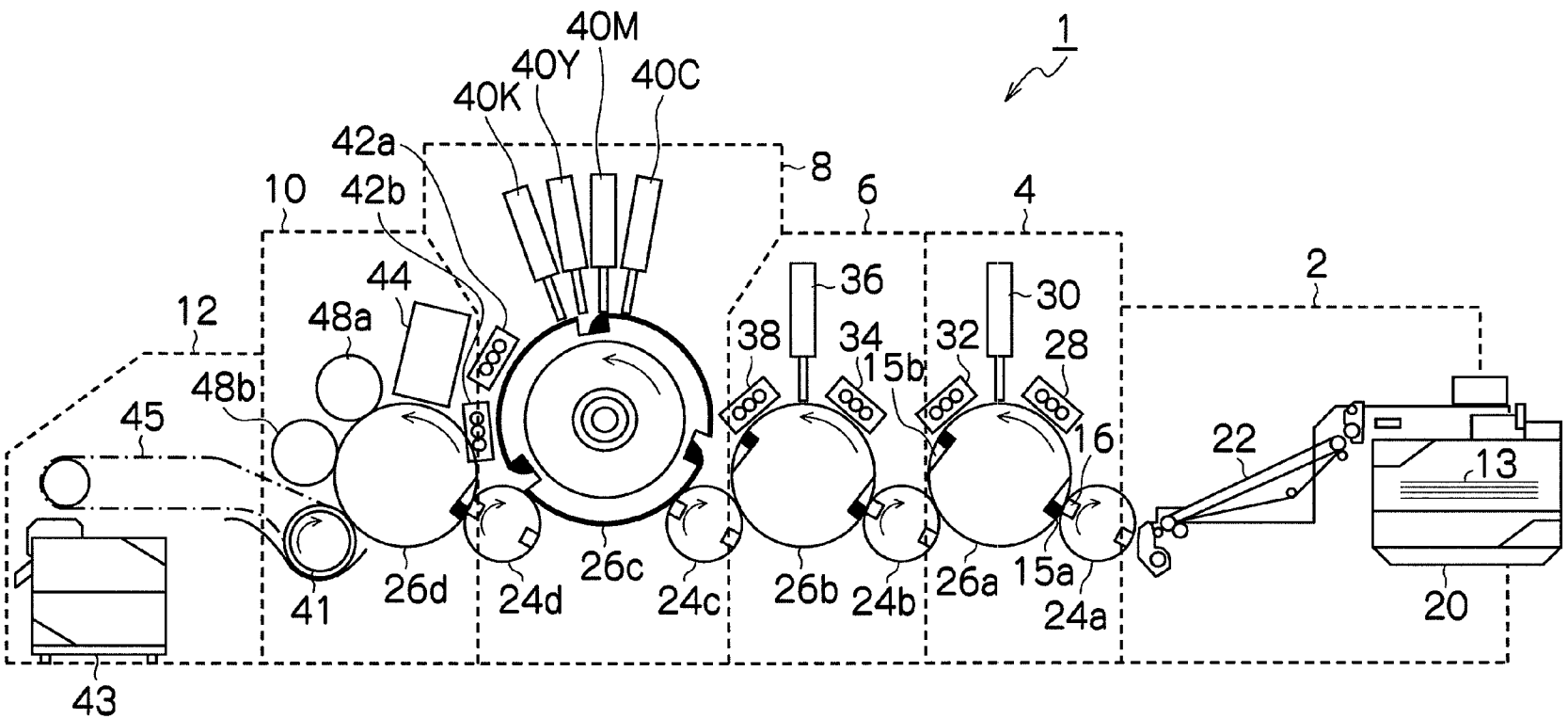
FIG. 1 is a general schematic drawing showing an inkjet recording apparatus.

FIG. 1 is a general schematic drawing showing an inkjet recording apparatus 1 according to a first embodiment of the present invention. FIG. 1 shows the inkjet recording apparatus 1 of a drum conveyance type, in which paper 13 is held and conveyed on circumferential surfaces of drum-shaped conveyance members, as an embodiment of the inkjet recording apparatus according to the present invention. The inkjet recording apparatus according to the present invention is not limited to the drum conveyance type, but may be of other types such as a belt conveyance type and an intermediate transfer type.

The inkjet recording apparatus 1 shown in FIG. 1 is a single side machine, which is capable of printing only onto one surface of the paper (recording medium) 13. The inkjet recording apparatus 1 includes: a paper supply unit 2, which supplies the paper 13; a permeation suppression processing unit (permeation suppression agent deposition unit) 4, which carries out permeation suppression processing (formation of permeation suppression layer) on the paper 13; a treatment liquid deposition unit 6, which deposits treatment liquid onto the paper 13; a print unit (image recording unit, ink deposition unit) 8, which performs image recording by depositing ink onto the paper 13; a fixing unit 10, which fixes the image formed on the paper 13; and a paper output unit 12, which conveys and outputs the paper 13 on which the image has been formed.

<Supply of Paper>

The paper supply unit 2 is provided with a paper supply platform 20, on which pieces of the paper 13 are stacked. A feeder board 22 is connected to the front (the left-hand side in FIG. 1) of the paper supply platform 20, and the paper (cut sheets) 13 stacked on the paper supply platform 20 are supplied one sheet at a time, successively from the uppermost sheet, to the feeder board 22. The paper 13 that has been conveyed to the feeder board 22 is transferred through a transfer drum 24*a* to the surface (circumferential surface) of a pressure drum 26*a* of the permeation suppression processing unit 4.

In the present embodiment, mat coated paper (e.g., Urite, made by Nippon Paper) is used as the paper 13.

<Formation of Permeation Suppression Layer Supply of Paper>

The permeation suppression processing unit 4 is provided with a paper preheating unit 28, a permeation suppression agent head 30 and a permeation suppression agent drying unit 32 at positions opposing the surface of the pressure drum 26*a*, in this order from the upstream side in terms of the direction of rotation of the pressure drum 26*a* (the counter-clockwise direction in FIG. 1).

Each of the paper preheating unit 28 and the permeation suppression agent drying unit 32 is provided with a heater of which the temperature can be controlled within a prescribed range. When the paper 13 held on the pressure drum 26*a* passes through the positions opposing the paper preheating unit 28 and the permeation suppression agent drying unit 32, the paper 13 is heated by heaters (infrared heaters) in these units.

The permeation suppression agent ejection head 30 ejects and deposits droplets of a permeation suppression agent onto the paper 13 that is held on the pressure drum 26*a*. The permeation suppression agent ejection head 30 adopts the same composition as heads 40C, 40M, 40Y and 40K of the print unit 8, which is described below.

In the present embodiment, the inkjet head is used as the device for carrying out the permeation suppression processing on the surface of the paper 13; however, there are no particular restrictions on the device that carries out the permeation suppression processing. For example, it is also possible to use various other methods, such as a spray method, application method, or the like.

For the permeation suppression agent, a liquid in which resin is dispersed as emulsion, or dissolved, is used. When depositing the permeation suppression agent onto the paper 13, the paper 13 is heated to have the surface temperature T1 above the minimum film forming temperature Tf1 of the resin in the permeation suppression agent. Hence, upon the deposition on the paper 13, the resin immediately forms a suitable resin film (permeation suppression layer) and suitably suppresses the permeation of the solvent in the ink, which is deposited later, into the paper 13. The differential between Tf1 and T1 is desirably 10 to 20° C.

In the present embodiment, it is preferable to use a thermoplastic resin latex solution as the permeation suppression agent. Of course, the permeation suppression agent is not limited to being the thermoplastic resin latex solution, and for example, it is also possible to use lamina particles (e.g., mica), or a liquid rappelling agent (a fluoro-coating agent), or the like. An organic solvent or water, for example, is used as the solvent for the permeation suppression agent solution. As an organic solvent for the permeation suppression agent, it is possible to use methyl ethyl ketone, a petroleum material, or the like.

In the present embodiment, the method of adjusting the temperature of the paper 13 employs the method which uses the heater facing the surface of the pressure drum 26*a*, for example. It is also possible to employ a method which uses a heater disposed inside the pressure drum 26*a*; or a method which heats the recording medium 13 by directing a hot air flow onto the upper surface of the paper 13. Furthermore, it is also possible to combine these methods in an appropriate fashion.

<Deposition of Aggregating Treatment Liquid>

The treatment liquid deposition unit 6 is arranged after the permeation suppression processing unit 4. A transfer drum 24*b* is arranged between the pressure drum 26*a* of the permeation suppression agent deposition unit 4 and a pressure drum 26*b* of the treatment liquid deposition unit 6, so as to make contact with same. Hence, after the permeation suppression processing is carried out, the paper 13 that is held on the pressure drum 26*a* of the permeation suppression processing unit 4 is transferred through the transfer drum 24*b* to the pressure drum 26*b* of the treatment liquid deposition unit 6.

The leading edge of the paper 13 is held by one of grippers 15*a* and 15*b* on the pressure drum 26*a*, and the paper 13 is conveyed in the direction of rotation (the counter-clockwise direction in FIG. 1) of the pressure drum 26*a*. The leading edge of the paper 13 on which the prescribed processing has been carried out is transferred through the transfer drum 24*b*. In the present embodiment, the two grippers 15*a* and 15*b* are arranged on the pressure drum 26*a*, and a gripper 16 is arranged on the transfer drum 24*b*. A similar composition is also employed for the other pressure drums 26*b*, 26*c* and 26*d*.

The leading edge of the paper 13 is transferred from the pressure drum 26*a* to the transfer drum 24*b* and is held by the gripper 16. The paper 13 is then conveyed in the direction of rotation (the clockwise direction in FIG. 1) of the transfer drum 24*b*, and is transferred to the subsequent pressure drum 26*b*. A similar composition is also employed for the other transfer drums 24*a*, 24*c* and 24*d*.

The treatment liquid deposition unit 6 is provided with a paper preheating unit 34, a treatment liquid head 36 and a treatment liquid drying unit 38 at positions opposing the surface of the pressure drum 26*b*, in this order from the upstream side in terms of the direction of rotation of the pressure drum 26*b* (the counter-clockwise direction in FIG. 1).

The respective units of the treatment liquid deposition unit 6 (namely, the paper preheating unit 34, the treatment liquid head 36 and the treatment liquid drying unit 38) use similar compositions to the paper preheating unit 28, the permeation suppression agent head 30 and the permeation suppression agent drying unit 32 of the permeation suppression processing unit 4, and detailed descriptions are omitted here. Of course, it is also possible to employ different compositions from the permeation suppression processing unit 4.

The treatment liquid (aggregating treatment liquid) used in the present embodiment is an acidic liquid that has the action of aggregating the coloring materials contained in the inks that are ejected onto the paper 13 respectively from the heads 40C, 40M, 40Y and 40K disposed in the print unit 8, which is arranged at a downstream stage.

On the paper 13 transferred to the treatment liquid deposition unit 6, the treatment liquid is deposited by the treatment liquid head 36 to form the liquid layer of 5 μm thick on the whole surface. In the present embodiment, since the inkjet system is employed, it is possible to selectively deposit the treatment liquid in accordance with the image signal (image data). In this case, the drying duration can be shortened and the required heating energy can be reduced.

Moreover, it is also possible to apply the treatment liquid by an application device such as a roller, instead of the inkjet head. In this case, it is possible to deposit the treatment liquid in a thinner layer than the case where the inkjet head is used. In this case also, the drying duration can be shortened and the required heating energy can be reduced.

The heating temperature of the heater of the treatment liquid drying unit 38 is set to a temperature (e.g., 70° C.) that is suitable to dry the treatment liquid having been deposited on the surface of the paper 13 by the ejection operation of the treatment liquid head 36 arranged to the upstream side in terms of the direction of rotation of the pressure drum 26*b*, and thereby a solid or semi-solid aggregating treatment agent layer (a thin film layer of dried treatment liquid) is formed on the paper 13. It is possible to carry out an additional drying (e.g., at 60° C.) on the transfer drum 24*c* to the print unit 8.

Furthermore, it is also desirable to adopt, either in conjunction with the drying process by the heater described above, or independently, an air flow drying process with dry air flow. For example, the paper 13 is dried for one second using a hot air flow at 70° C., to form the solid or semi-solid aggregating treatment agent layer on the paper 13.

Here, the term of "solid or semi-solid aggregating treatment agent layer" includes an aggregating treatment agent layer having a water content rate of 0% to 70%, where the water content rate is defined as:

> "Water content rate"="Weight of water contained in treatment liquid after drying, per unit surface area ($g/m^2$)"/"Weight of treatment liquid after drying, per unit surface area ($g/m^2$)".

In other words, the water content rate is defined as a ratio ($X_2/X_1$) of a weight $X_2$ ($g/m^2$) per unit surface area of water contained in the aggregating treatment agent to a weight $X_1$ ($g/m^2$) per unit surface area of the treatment liquid.

As a method for calculating the water content rate of the aggregating treatment agent, a sheet of paper of a prescribed size (e.g., 100 mm×100 mm) is cut out, the total weight of the paper after the deposition of the treatment liquid (the total weight of the paper and the deposited treatment liquid before drying) and the total weight of the paper after drying of the treatment liquid (the total weight of the paper and the deposited and dried treatment liquid) are measured respectively, and the reduction in the amount of water due to drying (the amount of water evaporated) is determined from the difference between the two weights. Furthermore, the amount of water contained in the treatment liquid before drying is calculated from the treatment liquid preparation method.

It has been ascertained that if the ink is deposited on the liquid layer of the treatment liquid, the ink (coloring material) floats (moves about) in the treatment liquid film when the ink aggregates. In cases where high image quality is pursued, it is found that image quality becomes worse if such ink flotation occurs.

In order to prevent floating (movement) of the coloring material of the ink in the treatment liquid film, it has been found to be effective to render the treatment liquid film to a solid or semi-solid state by drying and evaporating off the treatment liquid before the deposition of the ink droplets after the deposition of the treatment liquid. As a result of evaluating this with respect to the water content rate in the treatment liquid film, it is found that dot movement caused by floating of the coloring material of the ink become inconspicuous if the treatment liquid film is dried to a solid or semi-solid state by evaporating off the water to the above-described water content rate of 70% or lower.

Furthermore, movement of the coloring material assumed a satisfactory level that was imperceptible by visual inspection when the treatment liquid was dried until the water content rate of 50% or lower. Thus, experimental results which showed that image deterioration can be prevented were obtained. The following Table 1 shows the experimental results.

TABLE 1

| | Level 1 | Level 2 | Level 3 | Level 4 | Level 5 |
|---|---|---|---|---|---|
| Drying step | No | Yes | Yes | Yes | Yes |
| Total weight ($g/m^2$) | 10.0 | 6.0 | 4.0 | 3.0 | 1.3 |
| Weight of water ($g/m^2$) | 8.7 | 4.7 | 2.7 | 1.5 | 0 |
| Water content rate (%) | 87 | 78 | 67 | 50 | 0 |
| Coloring material fixation (Coloring material floatation) | Poor (defective) | Fair (slight movement) | Good (inconspicuous movement) | Excellent | Excellent |

It is desirable that the paper 13 is preheated by the heater of the paper preheating unit 34, before depositing the treatment liquid on the paper 13, as in the present embodiment. In this case, it is possible to restrict the heating energy required to dry the treatment liquid to a low level, and therefore energy savings can be made.

<Image Recording (Ink Deposition and Solvent Drying)>

The print unit 8 is arranged after the treatment liquid deposition unit 6. The transfer drum 24*c* is arranged between the pressure drum 26*b* of the treatment liquid deposition unit 6 and the pressure drum 26*c* of the print unit 8, so as to make contact with same. Hence, after the treatment liquid is deposited and the solid or semi-solid aggregating treatment agent layer is formed on the paper 13 that is held on the pressure drum 26*b* of the treatment liquid deposition unit 6, the paper 13 is transferred through the transfer drum 24*c* to the pressure drum 26*c* of the print unit 8.

The print unit 8 is provided with the heads 40C, 40M, 40Y and 40K, which correspond respectively to the four colors of ink, C, M, Y and K, and solvent drying units 42*a* and 42*b* at positions opposing the surface of the pressure drum 26*c*, in this order from the upstream side in terms of the direction of rotation of the pressure drum 26*c* (the counter-clockwise direction in FIG. 1).

The heads 40C, 40M, 40Y and 40K employ the inkjet type recording heads (inkjet heads), similarly to the above-described permeation suppression agent head 30 and treatment liquid head 36. The heads 40C, 40M, 40Y and 40K respectively eject droplets of corresponding colored inks onto the paper 13 held on the pressure drum 26*c*.

Figure 2:
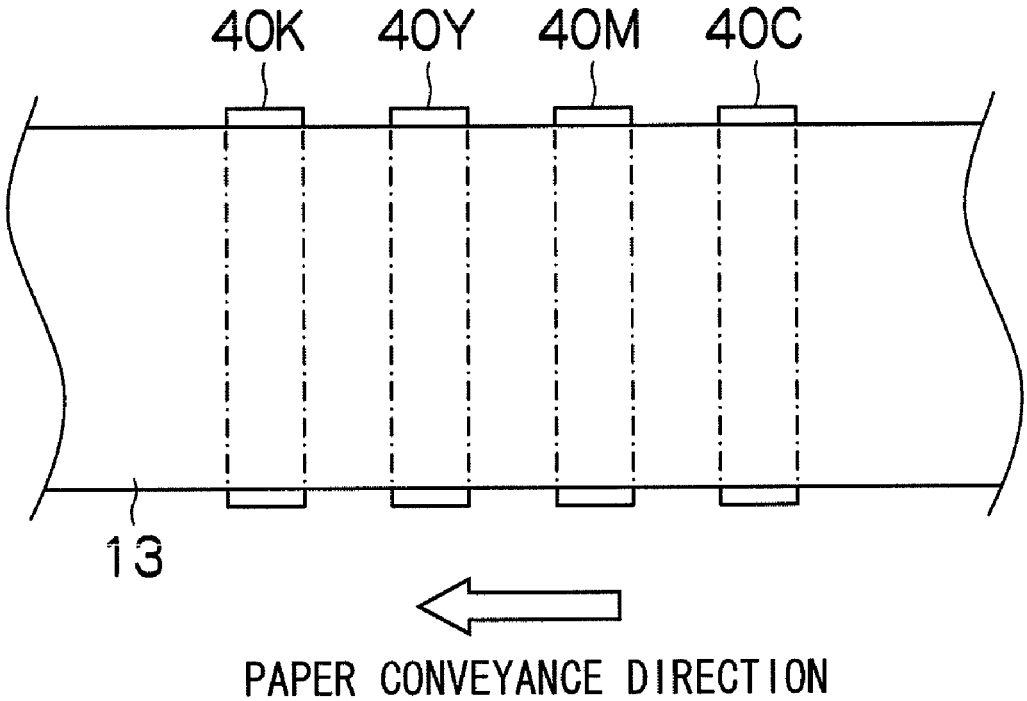
FIG. 2 is a plan diagram showing a printing unit.

As shown in FIG. 2, each of the heads 40C, 40M, 40Y and 40K is a full-line head having a length corresponding to the maximum width of the image forming region of the paper 13 held on the pressure drum 26*c*, and having a plurality of nozzles (see FIG. 3) for ejecting the ink, which are arranged on the ink ejection surface of the head through the full width of the image forming region. The heads 40C, 40M, 40Y and 40K are arranged so as to extend in a direction that is perpendicular to the direction of rotation of the pressure drum 26*c* (the conveyance direction of the paper 13).

According to the composition in which the full line heads having the nozzle rows covering the full width of the image forming region of the paper 13 are provided respectively for the colors of ink, it is possible to record an image on the image forming region of the paper 13 by performing just one operation of moving the paper 13 and the heads 40C, 40M, 40Y and 40K relatively with respect to each other (in other words, by one sub-scanning action).

Therefore, it is possible to achieve a higher printing speed compared to a case that uses a serial (shuttle) type of head moving back and forth reciprocally in the main scanning direction, which is the direction perpendicular to the sub-scanning direction or the conveyance direction of the paper 13, and hence it is possible to improve the print productivity.

Although the configuration with the four colors of C, M, Y and K is described in the present embodiment, the combinations of the ink colors and the number of colors are not limited to those. Light and/or dark inks, and special color inks can be added as required. For example, a configuration is possible in which heads for ejecting light-colored inks, such as light cyan and light magenta, are added. Furthermore, there is no particular restriction on the arrangement sequence of the heads of the respective colors.

The inkjet recording apparatus 1 according to the present embodiment is able to record on the paper 13 up to a maximum size of 720 mm×520 mm, and hence the print unit 8 is provided with the drum (the pressure drum 26*c*) having a diameter of 810 mm corresponding to the maximum width of 720 mm. When depositing the ink droplets, the drum rotation peripheral speed is 530 mm/sec, the ink ejection volume is 2 pl per ejection, and the recording density is 1200 dpi in both the main scanning direction and the sub-scanning direction.

Each of the solvent drying units 42*a* and 42*b* has a composition provided with a heater of which the temperature can be controlled within a prescribed range, similarly to the paper preheating units 28 and 34, the permeation suppression agent drying unit 32, and the treatment liquid drying unit 38, which have been described above. As described hereinafter, when ink droplets are deposited onto the solid or semi-solid aggregating treatment agent layer, which has been formed on the paper 13, an ink aggregate (coloring material aggregate) is formed on the paper 13, and furthermore, the ink solvent that has separated from the coloring material spreads, so that a liquid layer containing dissolved aggregating treatment agent is formed. The solvent component (liquid component) left on the paper 13 in this way is a cause of curling of the paper 13 and also leads to deterioration of the image. Therefore, in the present embodiment, after depositing the droplets of the colored inks from the corresponding heads 40C, 40M, 40Y and 40K onto the paper 13, the heaters of the solvent drying units 42*a* and 42*b* heat the paper 13 so that the solvent component is evaporated off and the paper 13 is dried.

The inkjet recording apparatus 1 according to the present embodiment carries out the solvent drying process as follows: holding the paper 13 on the transfer drum 24*c* at 25° C. while drying with a hot air flow at 70° C. for 2 seconds, then holding the paper 13 on the pressure drum 26*c* at 50° C. while drying with a hot air flow at 70° C. for 1 second, and further holding the paper 13 on the pressure drum 26*d* at 60° C. while drying with a hot air flow at 70° C. for 2 seconds.

<Fixing Process>

The fixing unit 10 is arranged after the print unit 8. The transfer drum 24*d* is arranged between the pressure drum 26*c* of the print unit 8 and the pressure drum 26*d* of the fixing unit 10, so as to make contact with same. Hence, after the colored inks are deposited on the paper 13 that is held on the pressure drum 26*c* of the print unit 8, the paper 13 is transferred through the transfer drum 24*d* to the pressure drum 26*d* of the fixing unit 10.

The fixing unit 10 is provided with a print determination unit 44, which reads in the print results of the print unit 8, and heating rollers 48*a* and 48*b* at positions opposing the surface of the pressure drum 26*d*, in this order from the upstream side in terms of the direction of rotation of the pressure drum 26*d* (the counter-clockwise direction in FIG. 1).

The print determination unit 44 includes an image sensor (a line sensor, or the like), which captures an image of the print result of the print unit 8 (the droplet ejection results of the heads 40C, 40M, 40Y and 40K), and functions as a device for checking for nozzle blockages and other ejection defects, on the basis of the droplet ejection image captured through the image sensor.

The paper 13 on which the image has been recorded is held on the pressure drum 26*d* at 60° C., and is subjected to heat and press fixing process by the heating rollers 48*a* and 48*b* set at 110° C. with the nip pressure of 1 MPa. In the present embodiment, the permeation suppression agent or the ink contains polymer resin (particles), and the heating temperature is set according to the melting temperature of the polymer resin to melt the polymer particles, so that the bonding of the polymer particles is strengthened and the bonding between the paper 13 and the polymer particles is also strengthened.

Furthermore, it is also desirable to adopt, either in conjunction with the heat and press fixing process, or independently, a fixing process by using a transparent UV (ultraviolet curable) ink to fix the image on the paper 13. More specifically, it is also a desirable configuration where a transparent UV ink head is arranged to deposit the transparent UV ink onto the paper 13 on which the image has been recorded, a UV lamp is arranged to irradiate UV light onto the paper 13 on which the transparent UV ink has been deposited, so that the UV lamp cures the transparent UV ink by irradiating UV light onto the transparent UV ink on the paper 13 when the paper 13 passes the positions opposing the UV lamp after the transparent UV ink has been deposited on the paper 13.

The transparent UV ink head employs the same composition as the heads 40C, 40M, 40Y and 40K of the print unit 8, and ejects droplets of the transparent UV ink so as to deposit the droplets of the transparent UV ink over the colored inks having been deposited on the paper 13 by the heads 40C, 40M, 40Y and 40K. Of course, it may also employ a composition different than the heads 40C, 40M, 40Y and 40K of the print unit 8.

In this case, it is preferable that a transparent UV ink droplet deposition volume control unit (not shown) controls a volume (droplet ejection volume of the transparent UV ink) of droplet ejected from the nozzle of the transparent UV ink head so that the film thickness of the transparent UV ink after the irradiation of the UV light is not more than 5 μm (desirably not more than 3 μm, and more desirably not less than 1 μm and not more than 3 μm). Here, the "film thickness of the transparent UV ink after the irradiation of the UV light" means the thickness of the film of the transparent UV ink having been irradiated with UV light by the UV lamp, and in the case where a plurality of the UV lamps are arranged, the thickness of the film of the transparent UV ink having been irradiated with UV light by the UV lamp that is positioned at the most downstream side in terms of the conveying direction of the paper 13.

<Paper Outputting>

The paper output unit 12 is arranged after the fixing unit 10. The paper output unit 12 is provided with a paper output drum 41, which receives the paper 13 on which the image has been fixed, a paper output platform 43, on which the paper 13 is stacked, and a paper output chain 45 having a plurality of paper output grippers, which is spanned between a sprocket arranged on the paper output drum 41 and a sprocket arranged above the paper output platform 43.

Although FIG. 1 shows the single side machine, which is capable of printing only onto one surface of the paper 13, the present invention can be applied to a double side machine, which is capable of printing onto both surfaces of the paper 13. The double side machine includes, for example: a reversing unit 202, which turns over the paper 13 on which an image has been recorded on one side thereof, and a composition which carries out an image recording on the other side of the paper 13 (it is possible to use the same composition with the composition carrying out the image recording on the first side of the paper 13). Moreover, it is possible to dispense with the treatment liquid deposition unit 6 shown in FIG. 1.

Description of Material

The material of the permeation suppression agent, the treatment liquid (aggregating treatment agent) and the ink used in the present embodiment is described below.

<Permeation Suppression Agent>

The material of the permeation suppression agent used in the present embodiment is described below. The permeation suppression agent used in the present embodiment contains thermoplastic resin.

It is preferable that the glass transition temperature Tg of the thermoplastic resin in the permeation suppression agent used in the present embodiment is not lower than −10° C. and not higher than 100° C., desirably not lower than 10° C. and not higher than 70° C., and more desirably not lower than 30° C. and not higher than 50° C. If the glass transition temperature Tg of the thermoplastic resin is too low, there is a problem in that the thermoplastic resin is liable to form a film nearby the nozzle surface when the permeation suppression agent is ejected, and the reliability of the ejection of the permeation suppression agent is lowered. On the other hand, if the glass transition temperature Tg of the thermoplastic resin is too high, there is a problem in that it is necessary to apply a large quantity of heat to form a film.

It is possible that the thermoplastic resin is contained in a liquid which is described later, in a state of being dissolved or in a state of particles dispersed. When the permeation suppression agent is ejected, it is more desirable that the particles of the thermoplastic resin are dispersed in the liquid as the dispersion medium, since the viscosity of the dispersion is lower than the solution. In the case where the thermoplastic resin is used as the particles, it is desirable that the particle size is in the range of not smaller than 0.01 μm and not larger than 5 μm, and more desirably, the range of not smaller than 0.05 μm and not larger than 1 μm. If the particle size is too small, there is a problem in that the particles are liable to permeate into paper and not to form a film on the surface of the paper. On the other hand, if the particle size is too large, there are problems in that it is difficult to form a sufficient film even applying heat, and the nozzle is clogged when performing the ejection.

Desirably, the concentration of the thermoplastic resin is in the range of not lower than 1 wt % and not higher than 40 wt %, more desirably, the range of not lower than 5 wt % and not higher than 30 wt %, and even desirably, the range of not lower than 10 wt % and not higher than 20 wt %. If the concentration of the thermoplastic resin is too low, there is a problem in that the thermoplastic resin is liable not to sufficiently form a film and defects partially occur. On the other hand, if the concentration of the thermoplastic resin is too high, there are problems in that the storage stability of the liquid is low (the resin is liable to precipitate), and the viscosity of the liquid is too high.

The thermoplastic resin used in the present embodiment can be any thermoplastic resin satisfying the above-described conditions of the glass transition temperature Tg, the particle size and the weight percent concentration, and specific examples thereof include: olefin polymer and copolymer, vinyl chloride copolymer, vinylidene chloride copolymer, alkanoic acid vinyl polymer and copolymer, alkanoic acid allyl polymer and copolymer, styrene and styrene-derivative polymer and copolymer, olefin-styrene-olefin-unsaturated carboxylic acid ester copolymer, acrylonitrile copolymer, methacrylonitrile copolymer, alkyl vinylether copolymer, acrylate ester polymer and copolymer, methacrylate acid ester polymer and copolymer, styrene-acrylate ester copolymer, styrene-methacrylate ester copolymer, itaconic acid diester polymer and copolymer, maleic anhydride copolymer, acrylamide copolymer, methacrylamide copolymer, hydroxy modified silicone resin, polycarbonate resin, ketone resin, polyester resin, silicone resin, amide resin, hydroxy- and carboxyl-modified polyester resin, butyral resin, polyvinylacetal resin, cyclized rubber-methacrylate copolymer, cyclized rubber-acrylic ester copolymer, copolymer having heterocycle (heterocycle may be furan, tetrahydrofuran, thiophene, dioxane, dioxofuran, lactone, benzofuran, benzothiophene and 1,3-dioxetane, for example), cellulosic resin, fatty acid modified cellulosic resin, and epoxy resins.

Nonaqueous solvent in which the above-described thermoplastic resin is dissolved or dispersed is described below. The nonaqueous solvent used in the present embodiment can be any nonaqueous solvent in which the above-described thermoplastic resin can be stably dissolved or dispersed, and provided that the solvent causes no curl or slight curl when permeating into paper. The nonaqueous solvent can be any of straight chain or branched aliphatic hydrocarbons, alicyclic hydrocarbons, aromatic hydrocarbons and halogen-substituted compounds thereof. Specific examples thereof include: octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar is the trade name of Exxon), Shellsol 70, Shellsol 71 (Shellsol is the trade name of Shell Oil), Amsco OMS and Amsco 460 solvent (Amsco is the trade name of American Mineral Spirits). These solvents may be used singly or as a combination thereof.

<Example of Composition of Permeation Suppression Agent>

Example of composition of the permeation suppression agent is described below.

A mixed solution was prepared by mixing 10 g of a dispersion stabilizer resin (Q-1) having the following structure:

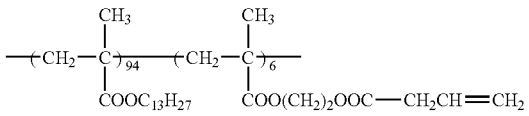

$\overline{M}w=4\times10^4$ (weight composition ratio), 100 g of vinyl acetate and 384 g of Isopar H (made by Exxon), and was heated to a temperature of 70° C. while being agitated in a nitrogen gas flow. Then, 0.8 g of 2,2'-azobis(isovaleronitrile) (A.I.V.N.) was added as a polymerization initiator, and the mixture was made react for 3 hours. 20 minutes after adding the polymerization initiator, white turbidity was produced and the reaction temperature rose to 88° C. A further 0.5 g of polymerization initiator was added and after making reaction for 2 hours, the temperature was raised to 100° C. and the mixture was agitated for 2 hours. Then, vinyl acetate that had not reacted was removed. The mixture was cooled and then passed through a 200-mesh nylon cloth. The white dispersed material thereby obtained was a latex having a polymerization rate of 90%, an average particle size of 0.23 μm and good monodisperse properties. The particle size was measured with a Horiba CAPA-500.

A portion of the white dispersed material was placed in a centrifuge (for example, rotational speed: $1\times10^4$ r.p.m.; operating duration: 60 minutes), and the precipitated resin particles were complemented and dried. The weight-average molecular weight (Mw), glass transition point (Tg) and minimum film forming temperature (MFT) of the resin particles were measured as follows: Mw was $2\times10^5$ (GPC value converted to value for polystyrene), Tg was 38° C. and MFT was 28° C.

The permeation suppression agent dispersion prepared as described above was deposited onto the paper 13. During deposition, the paper 13 was heated by the drum, and after the deposition, the Isopar H was evaporated off by blowing a hot air flow.

<Treatment Liquid (Aggregating Treatment Agent)>

Example of composition of the treatment liquid is described below.

| | |
|---|---|
| Citric acid (made by Wako Pure Chemical Industries): | 16.7% |
| Diethylene glycol monomethyl ether (made by Wako Pure Chemical Industries: | 20.0% |
| Zonyl FSN-100 (made by Dupont): | 1.0% |
| Deionized water: | 62.3% |

The physical properties of the treatment liquid thus prepared were measured as: the viscosity was 4.9 mPa·s, the surface tension was 24.3 mN/m and the pH was 1.5.

<Ink>

<Preparation of Polymer Dispersant P-1>

88 g of methylethyl ketone was introduced into a 1000 ml three-mouthed flask fitted with an agitator and cooling tube, and was heated to 72° C. in a nitrogen atmosphere, whereupon a solution formed by dissolving 0.85 g of dimethyl 2,2'-azobis isobutylate, 60 g of benzyl methacrylate, 10 g of methacrylic acid and 30 g of methyl methacrylate in 50 g of methylethyl ketone was added to the flask by titration over three hours. When titration had been completed and after reacting for a further hour, a solution of 0.42 g of dimethyl 2,2'-asobis isobutylate dissolved in 2 g of methylethyl ketone was added, the temperature was raised to 78° C. and the mixture was heated for 4 hours. The reaction solution thus obtained was suspended twice in an excess amount of hexane, and the precipitated resin was dried, yielding 96 g of a polymer dispersant P-1.

The composition of the resin thus obtained was confirmed using a 1H-NMR, and the weight-average molecular weight (Mw) determined by GPC was 44600. Moreover, the acid number of the polymer was 65.2 mg KOH/g as determined by the method described in Japanese Industrial Standards (JIS) specifications (JIS K 0070-1992).

<Preparation of Cyan Dispersion Liquid>

10 parts of Pigment Blue 15:3 (phthalocyanine blue A220 made by Dainichi Seika Color & Chemicals), 5 parts of the polymer dispersant P-1 obtained as described above, 42 parts of methylethyl ketone, 5.5 parts of an aqueous 1 mol/L NaOH solution, and 87.2 parts of deionized water were mixed together, and dispersed for 2 to 6 hours using 0.1 mm diameter zirconia beads in a beads mill.

The methylethyl ketone was removed from the obtained dispersion at 55° C. under reduced pressure, and moreover a portion of the water was removed, thus obtaining a cyan dispersion liquid having a pigment concentration of 10.2 wt %.

The cyan dispersion liquid forming a coloring material was prepared as described above.

An ink 1 (inkjet recording liquid) was prepared by mixing together components to achieve the ink compositions described below, using the coloring material (cyan dispersion liquid) obtained as described above.

<Example of Composition of Ink>

| | |
|---|---|
| Cyan pigment (Pigment Blue 15:3) | 4% |
| Polymer dispersant (P-1 described above) | 2% |
| Trioxypropylene glyceryl ether (Sannix GP250 (made by Sanyo Chemical Industries)) | 15% |
| Olefin E1010 (a surfactant, made by Nisshin Chemical Industry) | 1% |
| Deionized water | 78% |

The components of the liquids are described above as examples, and it is naturally possible to change the components within the scope of the present invention.

Structure of Head

Next, the structure of heads 40C, 40M, 40Y and 40K is described. The heads 40C, 40M, 40Y and 40K of the respective ink colors have the same structure, and a reference numeral 50 is hereinafter designated to any of the heads.

Figure 3A:
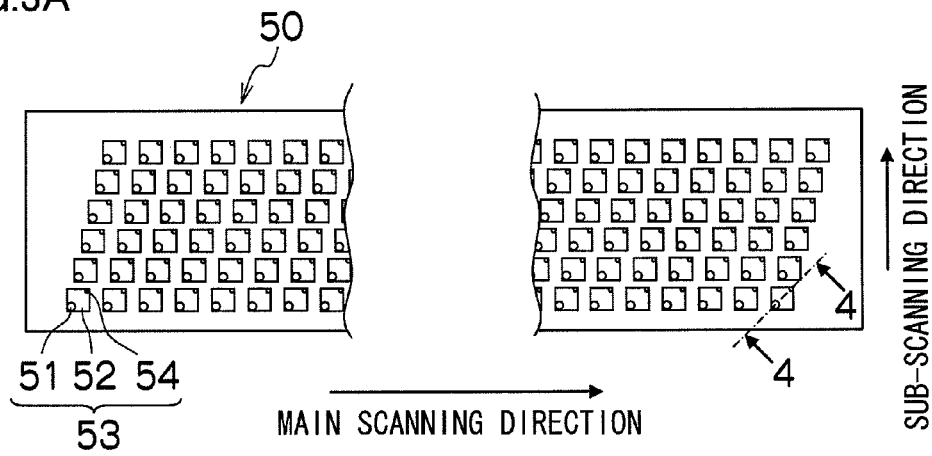
FIGS. 3A to 3C are plan view perspective diagrams showing embodiments of the composition of a print head.
Figure 3B:
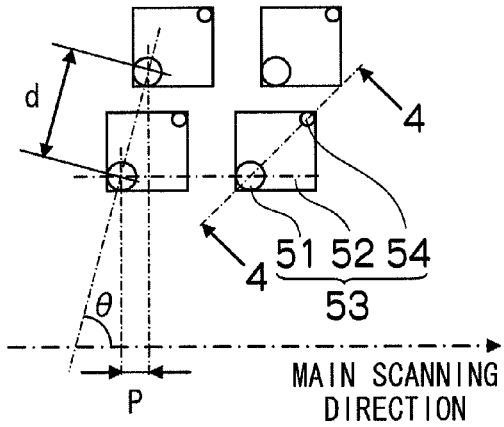
Figure 3C:
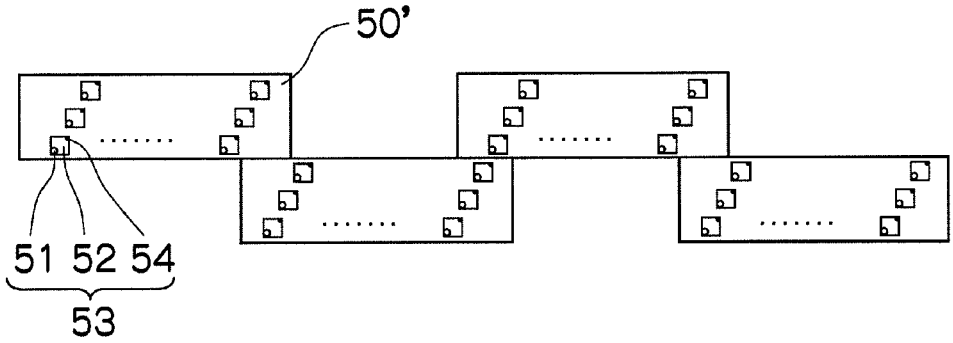
Figure 4:
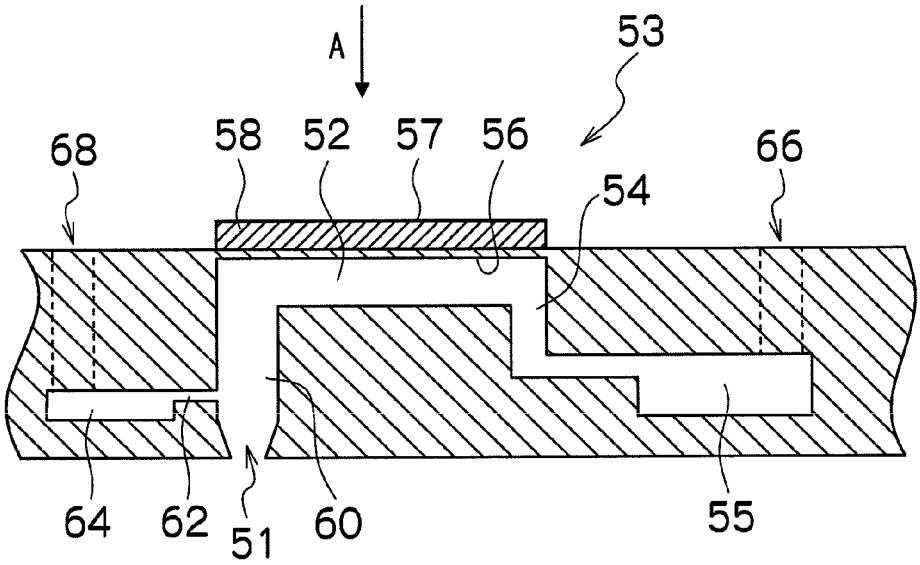
FIG. 4 is a cross-sectional diagram showing an ink chamber unit along line 4-4 in FIGS. 3A and 3B.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line 4-4 in FIGS. 3A and 3B). Furthermore, FIG. 5 is a flow channel composition diagram showing the structure of flow channels inside the head 50 (a plan view perspective diagram in direction A in FIG. 4).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the paper 13 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the paper 13 can be formed by arranging and combining, in a staggered matrix, short head blocks (head chips) 50' having a plurality of nozzles 51 arrayed in a two-dimensional fashion. Furthermore, although not shown in the drawings, it is also possible to compose a line head by arranging short heads in one row.

Figure 5:
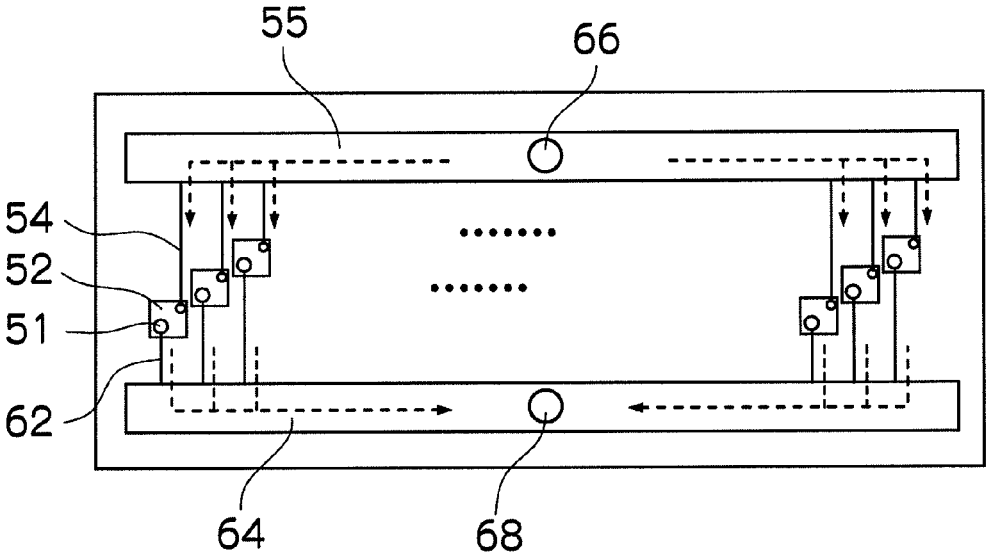
FIG. 5 is a schematic drawing showing the internal flow channel structure of the print head.

As illustrated in FIG. 5, the pressure chambers 52 provided corresponding to the respective nozzles 51 are approximately square-shaped in planar form, and a nozzle 51 and an ink inlet port 54 are provided respectively at either corner of a diagonal of each pressure chamber 52. Each pressure chamber 52 is connected through the ink inlet port 54 to a common flow channel 55. Furthermore, a nozzle flow channel 60 connected to each of the pressure chambers 52 is connected through an individual flow channel 62 to a common circulation flow channel 64. A supply port 66 and an outlet port 68 are provided in the head 50, the supply port 66 is connected to the common flow channel 55, and the outlet port 68 is connected to the common circulation flow channel 64.

In other words, the supply port 66 and the outlet port 68 of the head 50 are composed so as to be connected through an ink flow channel which includes the common flow channel 55, the ink inlet ports 54, the pressure chambers 52, the nozzle flow channels 60, the individual flow channels 62, and the common circulation flow channel 64. Consequently, a portion of the ink which has been supplied to the supply port 66 from outside the head is ejected from the nozzles 51, and the remainder of the ink passes successively through the common flow channel 55, the nozzle flow channels 60, the individual flow channels 62 and the common circulation flow channel 64 (in other words, it is circulated through the internal ink flow channel of the head) and then output to the exterior of the head from the outlet port 68.

As illustrated in FIG. 4, a desirable composition is one in which the individual flow channels 62 are connected to the nozzle flow channels 60 in the vicinity of the nozzles 51, and therefore since the ink is allowed to circulate in the vicinity of the nozzles 51, increase in the viscosity of the ink inside the nozzle 51 is prevented and stable ejection can be achieved.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chambers 52 from the common flow channel 55, through the ink inlet ports 54.

In the present embodiment, a piezoelectric element 58 is used as an ink ejection force generating device which causes ink to be ejected from a nozzle 50 provided in a head 51, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the paper 13 is moved along the breadthways direction (main scanning direction) of the paper 13, thereby performing printing in the breadthways direction, and when one printing action in the breadthways direction has been completed, the paper 13 is moved through a prescribed amount in the direction perpendicular to the breadthways direction (the sub-scanning direction), printing in the breadthways direction of the paper 13 is carried out in the next printing region, and by repeating this sequence, printing is performed over the whole surface of the printing region of the paper 13.

Configuration of Control System

Figure 6:
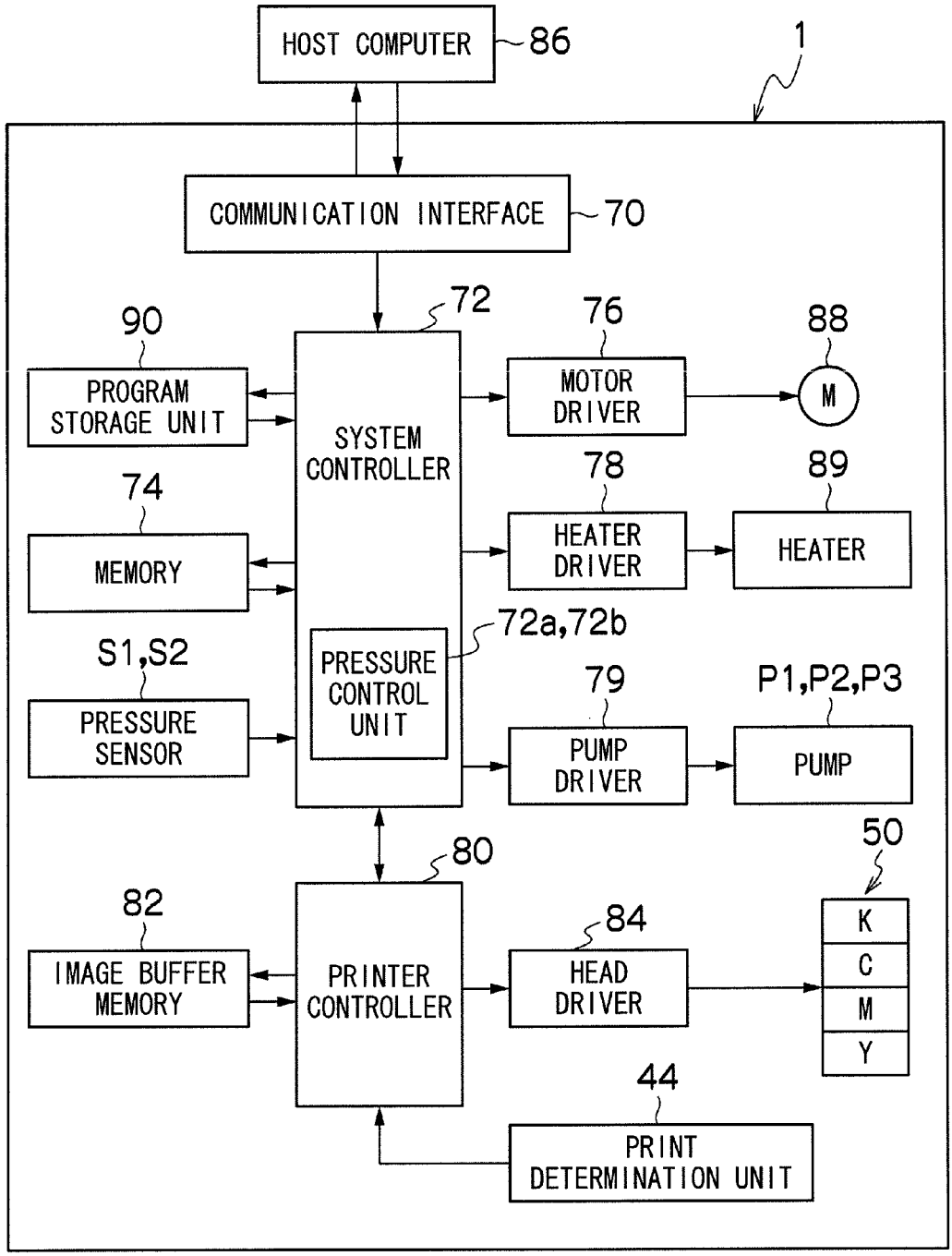
FIG. 6 is a principal block diagram showing a control system of the inkjet recording apparatus.

FIG. 6 is a principal block diagram showing the control system of the inkjet recording apparatus 1. The inkjet recording apparatus 1 includes a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB (Universal Serial Bus), IEEE1394, Ethernet, wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 10 through the communication interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective sections, such as the communication interface 70, the memory 74, the motor driver 76, the heater driver 78, and the like. The system controller 72 is made up of a central processing unit (CPU) and peripheral circuits thereof, and as well as controlling communications with the host computer 86 and controlling reading from and writing to the memory 74, and the like, and it generates control signals for controlling the motors 88 of the conveyance system and the heaters 89.

Furthermore, the system controller 72 is a controller which controls the driving of pumps P1, P2, P3 of the ink supply system. In particular, as described hereinafter, the pressure control unit 72*a* of the system controller 72 controls the driving of the first sub-pump P1 in accordance with the determination results of a pressure sensor S1 in such a manner that the interior of a liquid chamber 124 of a supply sub-tank 120 assumes a prescribed pressure, and furthermore controls the driving of the second sub-pump P2 in accordance with the determination results of a pressure sensor S2 in such a manner that the interior of a liquid chamber 134 of a recovery sub-tank 130 assumes a prescribed pressure (see FIG. 7).

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver (drive circuit) 76 drives the motor 88 in accordance with commands from the system controller 72. The heater driver 78 drives the heater 89 of the post-drying unit 42 and the like in accordance with commands from the system controller 72.

Furthermore, the pump driver 79 is a driver which drives the pumps P1, P2, P3 of the ink supply system in accordance with instructions from the pressure control unit 72*a* of the system controller 72.

The print controller 80 has a signal processing function for performing various tasks, compensations, and other types of processing for generating print control signals from the image data stored in the memory 74 in accordance with commands from the system controller 72 so as to supply the generated print control signals (dot data) to the head driver 84. Necessary signal processing is carried out in the print controller 80, and the ejection amount and the ejection timing of the ink from the respective recording heads 50 are controlled through the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect illustrated in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 4) of the recording heads 50 of the respective colors, on the basis of dot data supplied from the print controller 80, and supplies the generated drive signals to the piezoelectric elements 58. A feedback control system for maintaining constant drive conditions in the recording heads 50 may be included in the head driver 84.

The print determination unit 44 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print controller 80.

According to requirements, the print controller 80 makes various corrections with respect to the recording head 50 on the basis of information obtained from the print determination unit 44.

Various control programs are stored in the program storage unit 90, and the control programs are read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these recording media may also be provided. The program storage unit 90 may also be combined with a storage device for storing operational parameters, and the like (not illustrated).

Composition of Ink Supply System

Next, the composition of the ink supply system of the inkjet recording apparatus 1 is described.

Figure 7:
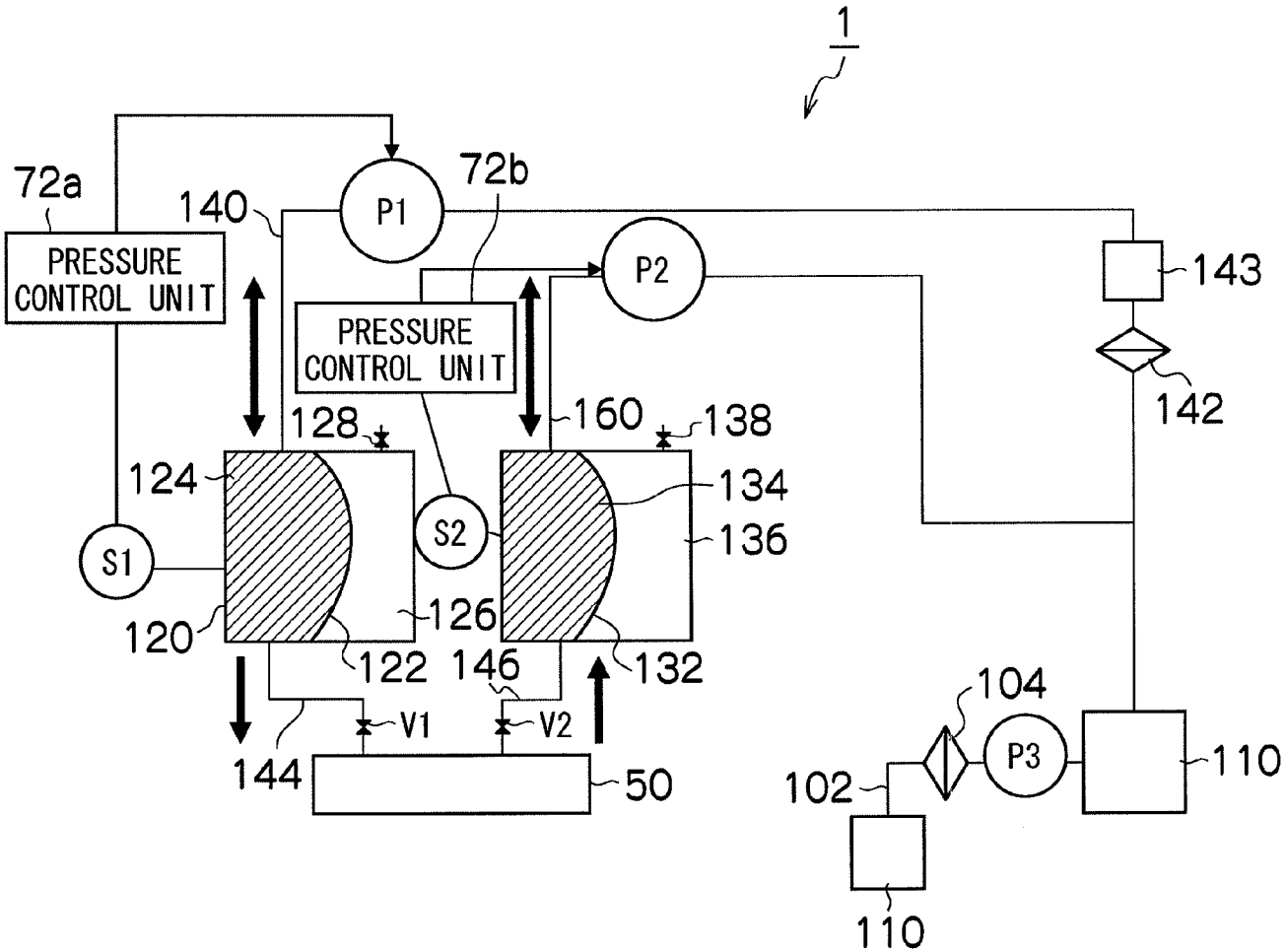
FIG. 7 is an approximate diagram showing the composition of an ink supply system of the inkjet recording apparatus.

FIG. 7 is an approximate diagram showing an embodiment of the composition of the ink supply system of the inkjet recording apparatus 1. In FIG. 7, in order to simplify the description, the ink supply system relating to only one color is depicted, but in the case of a plurality of colors, a plurality of similar compositions are provided.

The inkjet recording apparatus 1 illustrated in FIG. 7 includes: a buffer tank 110, which stores the ink supplied from a main tank 100; a pair of sub-tanks 120 and 130 (supply sub-tank 120 and recovery sub-tank 130), which are connected to the buffer tank 110; the head 50, which is connected to the sub-tanks 120 and 130, the pressure sensors S1 and S2, which determine the internal pressure of the sub-tanks 120 and 130 respectively; and the pumps P1 and P2, which adjust the interiors of the sub-tanks 120 and 130 respectively to prescribed pressures by moving the ink between the buffer tank 110 and the sub-tanks 120 and 130.

The main tank 100 is a base tank (ink supply source), which stores ink to be supplied to the head 50. The main tank 100 and the buffer tank 110 are connected through the supply flow channel 102. The supply flow channel 102 is provided with a filter 104 and the main pump P3 in this order from the upstream side (the main tank 100 side). By driving the main pump P3, the ink inside the main tank 100 is supplied through the supply flow channel 102 and the filter 104 to the buffer tank 110.

The buffer tank 110 is a liquid storage unit (liquid buffer chamber) that stores the ink supplied from the main tank 100. Furthermore, the buffer tank 110 is connected to the sub-tanks 120 and 130 and as described below, the ink is moved between the sub-tanks 120 and 130 by means of the first and second sub-pumps P1 and P2. It is possible to arrange an air connection port in the vertical upper portion of the buffer tank 110 so that the interior of the buffer tank 110 is connected to the outside air. By this means, when the ink is moved between the sub-tanks 120 and 130, it is possible to control the internal pressures of the sub-tanks 120 and 130 independently without the ink that has flown out from the sub-tanks 120 and 130 to the buffer tank 110 side reaching a dead-end situation.

The supply sub-tank 120 has a composition in which the interior of a sealed container is partitioned into two spaces (a liquid chamber 124 and a gas chamber 126) by means of a flexible film 122, and the liquid chamber 124 and the gas chamber 126 both have sealed interiors. The pressure sensor S1, which determines the internal pressure of the liquid chamber 124, is provided in the supply sub-tank 120. The supply sub-tank 120 is provided with an air opening valve 128, which can open and close the interior of the gas chamber 126 with respect to air.

Furthermore, one end of a first connecting flow channel 140, which connects to the buffer tank 110, is connected to the liquid chamber 124 of the supply sub-tank 120, and a filter 142 and a first sub-pump P 1 are provided in the flow channel 140 in this order from the upstream side (the side of the buffer tank 110).

By changing the direction of rotation (drive direction) and the amount of rotation of the first sub-pump P1, the ink is moved between the buffer tank 110 and the liquid chamber 124 of the supply sub-tank 120, and the interior of the liquid chamber 124 of the supply sub-tank 120 can be adjusted to a prescribed pressure. For example, when the first sub-pump P1 is driven in the forward direction, then the ink flows into the liquid chamber 124 of the supply sub-tank 120 from the buffer tank 110 side, and hence the internal pressure of the liquid chamber 124 of the supply sub-tank 120 can be raised. On the other hand, when the first sub-pump P1 is driven in the reverse direction, then the ink inside the liquid chamber 124 of the supply sub-tank 120 flows out to the buffer tank 110 side, and hence the internal pressure of the liquid chamber 124 of the supply sub-tank 120 can be lowered.

Preferably, the flexible film 122, which partitions the internal space of the supply sub-tank 120 into the two spaces (the liquid chamber 124 and the gas chamber 126) is constituted of an elastic film (made of rubber, for example). It is also possible to attenuate the sudden pressure changes caused by the first sub-pump P1 or the ink ejection from the head 50, by means of the elastic force of the flexible film (elastic film) 122 and an appropriate elastic force which is created by the compressive properties of the gas chamber 126. In the present embodiment, air is filled in the gas chamber 126, but there are no particular restrictions on the gas that is filled in the gas chamber 126.

The recovery sub-tank 130 uses the same composition as the supply sub-tank 120. In other words, the recovery sub-tank 130 has a composition in which the interior of a sealed container is partitioned into two spaces (a liquid chamber 134 and a gas chamber 136) by means of a flexible film 132, and the liquid chamber 134 and the gas chamber 136 both have sealed interior spaces. Moreover, the pressure sensor S2, which determines the internal pressure of the liquid chamber 134, is provided in the recovery sub-tank 130. The recovery sub-tank 130 is provided with an air opening valve 138, which can open and close the interior of the gas chamber 136 with respect to air. Preferably, the flexible film 132 is constituted by an elastic film (made of rubber, for example).

One end of a second connecting flow channel 160 is connected to the liquid chamber 134 of the recovery sub-tank 130. The second sub-pump P2 is provided in the second connecting flow channel 160.

By changing the direction of rotation (drive direction) and the amount of rotation of the second sub-pump P2, the ink is moved between the buffer tank 110 (or the supply sub-tank 120) and the recovery sub-tank 130, and hence the interior of the liquid chamber 134 of the recovery sub-tank 130 can be adjusted to a prescribed pressure.

For example, if the second sub-pump P2 is driven in the forward direction, the ink that has passed through the filter 142 from the buffer tank 110 (the first connecting flow channel 140) flows through the second branch flow channel 160B and into the liquid chamber 134 of the recovery sub-tank 130, and hence the internal pressure of the liquid chamber 134 of the recovery sub-tank 130 can be raised.

On the other hand, when the second sub-pump P2 is driven in the reverse direction, the ink inside the liquid chamber 134 of the recovery sub-tank 130 flows out to the buffer tank 110 (the second connecting flow channel 160) through the first branch flow channel 160A, and hence the internal pressure of the liquid chamber 134 of the recovery sub-tank 130 can be lowered. The ink that has flowed into the first connecting flow channel 140 side from the liquid chamber 134 of the recovery sub-tank 130 through the second connecting flow channel 160 moves into the buffer tank 110 or either passes directly through the filter 142 and moves into the liquid chamber 124 of the supply sub-tank 120. In other words, the ink inside the buffer tank 110 or the ink that has been circulated to the recovery sub-tank 130 from the supply sub-tank 120 through the head 50 as described below is subjected to the removal of foreign matter, such as portions of increased viscosity, by the filter 142, and is then supplied to the sub-tank 120. Consequently, good ink that does not include foreign material is circulated to the head 50 and therefore the ejection stability is improved.

The sub-tanks 120 and 130 are disposed in the vicinity of the head 50 vertically above same, and are connected to the head 50 through a first and a second circulation flow channels 144 and 146. More specifically, the liquid chamber 124 of the supply sub-tank 120 and the supply port 66 (see FIG. 5) of the head 50 are connected through the first circulation flow channel 144, and the liquid chamber 134 of the recovery sub-tank 130 and the outlet port 68 (see FIG. 5) of the head 50 are connected through the second circulation flow channel 146. The supply port 66 and the outlet port 68 of the head 50 are connected through the ink flow channel which is provided inside the head (the common flow channel 55, the pressure chambers 52, the common circulation flow channel 64, and the like) (see FIG. 5). In other words, the liquid chamber 124 of the supply sub-tank 120 and the liquid chamber 134 of the recovery sub-tank 130 are composed so as to be connected through the ink flow channel of the head 50. In the respective circulation flow channels 144 and 146, opening and closing valves V1 and V2 which open and close the respective flow channels are provided.

The pressure control unit 72*a* of the system controller 72 (see FIG. 6) controls the driving of the first sub-pump P1 on the basis of the determination result from the pressure sensor S1, in such a manner that the interior of the liquid chamber 124 of the supply sub-tank 120 is adjusted to a prescribed pressure, and furthermore, controls the driving of the second sub-pump P2 on the basis of determination results by the pressure sensor S2 in such a manner that the internal pressure of the liquid chamber 134 of the recovery sub-tank 130 assumes a prescribed value.

If the interior of the buffer tank 110, which is connected to the liquid chamber 124 of the supply sub-tank 120 and the liquid chamber 134 of the recovery sub-tank 130, is connected to the outside air, then it is possible to control the internal pressures of the liquid chamber 124 of the supply sub-tank 120 and the liquid chamber 134 of the recovery sub-tank 130 respectively and independently, without the ink that flows out from the liquid chamber 124 of the supply sub-tank 120 or the liquid chamber 134 of the recovery sub-tank 130 reaching a dead-end situation. In other words, it is possible to perform active sealed back pressure control that respectively and independently controls the internal pressures of the two sealed liquid chambers 124 and 134 by using a two-system pressure adjusting device.

Moreover, the pressure control units 72*a* and 72*b* of the system controller 72 set a prescribed pressure differential between the liquid chambers 124 and 134 in such a manner that the internal pressure of the liquid chamber 124 of the supply sub-tank 120 is relatively higher than the internal pressure of the liquid chamber 134 of the recovery sub-tank 130, and furthermore adjust the internal pressures of the liquid chambers 124 and 134 by controlling the driving of the first sub-pump P1 and the second sub-pump P2 in such a manner that a prescribed back pressure (negative pressure) is applied to the ink inside the nozzles 51 of the head 50.

Figure 8:
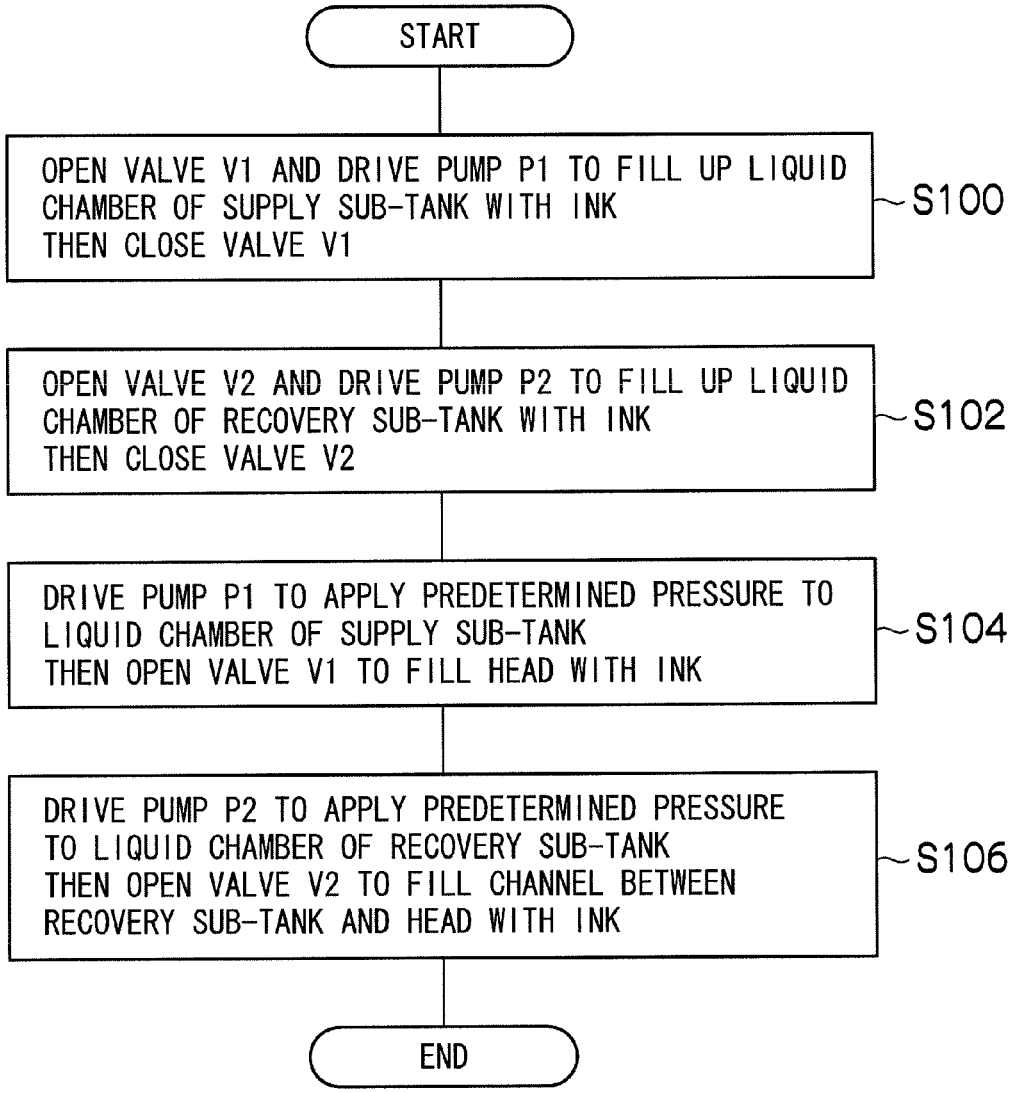
FIG. 8 is a flowchart showing an ink loading operation according to an embodiment.

FIG. 8 is a flowchart showing an embodiment of an ink loading operation. Here, in order to simplify the description, it is supposed that a prescribed amount of ink has already been supplied from the main tank 100 to the buffer tank 110 due to driving of the main pump P3. Furthermore, it is supposed that the opening and closing valves V0 to V2 are closed at the stage when the ink loading operation (ink filling operation) is started up.

In FIG. 8, firstly, at step S100, the opening and closing valve V1 of the first circulation flow channel 144 is opened, the first sub-pump P1 is driven in the forward direction, and the ink is supplied from the buffer tank 110 to the liquid chamber 124 of the supply sub-tank 120. When the ink has been filled into the liquid chamber 124 of the supply sub-tank 120, the opening and closing valve V1 of the first circulation flow channel 144 is set to a closed state.

Next, in step S102, the opening and closing valve V2 of the second circulation flow channel 146 is opened, the second sub-pump P2 is driven in the forward direction, and the ink is supplied from the buffer tank 110 through the second branch flow channel 160B to the liquid chamber 134 of the recovery sub-tank 130. When the ink has been filled into the liquid chamber 134 of the recovery sub-tank 130, the opening and closing valve V2 of the second circulation flow channel 146 is set to a closed state.

Next, at step S104, the first sub-pump P1 is driven in the forward direction, and pressure is applied in such a manner that the interior of the liquid chamber 124 of the supply sub-tank 120 assumes a prescribed pressure. Thereupon, the opening and closing valve V1 of the first circulation flow channel 144 is opened and the ink is filled into the head 50 and the first circulation flow channel 144.

Next, at step S106, the second sub-pump P2 is driven in the forward direction, and pressure is applied in such a manner that the interior of the liquid chamber 134 of the recovery sub-tank 130 assumes a prescribed pressure. Thereupon, the opening and closing valve V2 of the second circulation flow channel 146 is opened and the ink is filled into the second circulation flow channel 146 between the liquid chamber 134 of the recovery sub-tank 130 and the head 50. In this way, the ink loading operation (ink filling operation) is completed.

In the present embodiment, as illustrated in FIG. 7, the composition is explained above in which one head 50 is provided with respect to the pair of sub-tanks 120 and 130, but the implementation of the present invention is not limited to this and it is also possible to provide a plurality of heads 50.

Description of Film Position Initialization Operation

Figure 9:
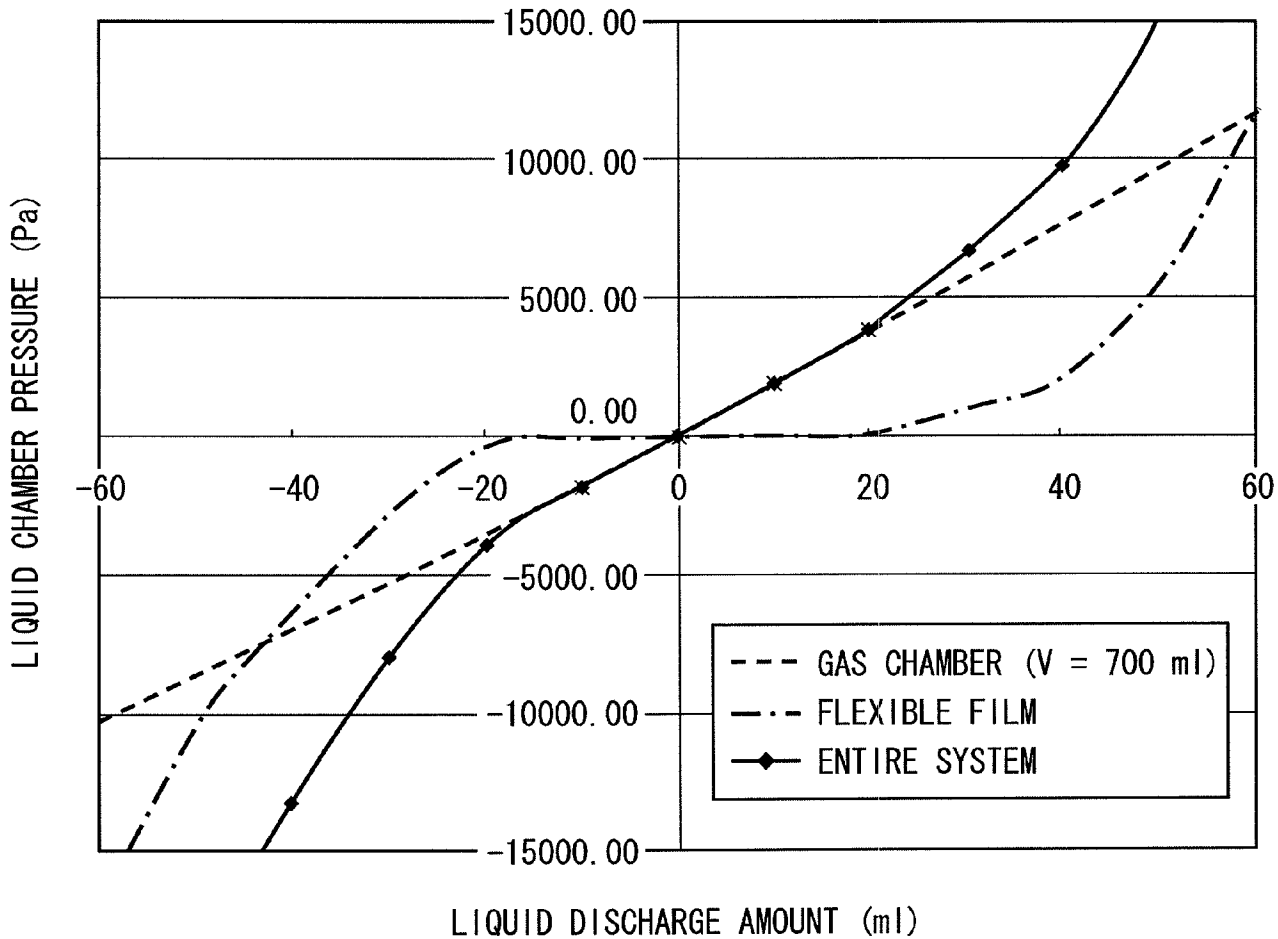
FIG. 9 is a diagram showing negative pressure characteristics in a sealed liquid chamber.

FIG. 9 shows negative pressure characteristics in the liquid chambers 124 and 134, and more specifically, FIG. 9 shows negative pressure characteristics (elasticity characteristics) (shown by a one-point chain line) of an elastic force of the flexible films 122 and 132, negative pressure characteristics (elasticity characteristics) (shown by a dashed line) of an elastic force of the gas chambers 126 and 136, and negative pressure characteristics (elasticity characteristics) (shown by a solid line) of the entire system combining the elastic force of the flexible films 122 and 132 and the elastic force of the gas chambers 126 and 136.

Here, the negative pressure characteristics refers to conditions of pressure fluctuations in the liquid chambers 124 and 134 when the ink is supplied to or discharged from the liquid chambers 124 and 134.

The negative pressure characteristics of the elastic force of the flexible films 122 and 132 refers to negative pressure characteristics in the liquid chambers 124 and 134 when the gas chambers 126 and 136 are opened to the air in the supply sub-tank 120 and the recovery sub-tank 130 of the present embodiment. Furthermore, the negative pressure characteristics of the elastic force of the gas chambers 126 and 136 refers to negative pressure characteristics in the liquid chambers 124 and 134 when the liquid chambers 124 and 134 and the gas chambers 126 and 136 are partitioned by hard panels or the like not having flexibility instead of the flexible films 122 and 132 in the supply sub-tank 120 and the recovery sub-tank 130 of the present embodiment.

The negative pressure characteristics of the entire system combining the elastic force of the flexible films 122 and 132 and the elastic force of the gas chambers 126 and 136 refers to negative pressure characteristics in the liquid chambers 124 and 134 when the gas chambers 126 and 136 are in the sealed state, and the liquid chambers 124 and 134 and the gas chambers 126 and 136 are portioned by the flexible films 122 and 132 in the supply sub-tank 120 and the recovery sub-tank 130 of the present embodiment.

As shown in FIG. 9, in regard to the negative pressure characteristics of the elastic force of the flexible films 122 and 132, there is almost no pressure change in the slackness region of the flexible films 122 and 132 while the ink supply/discharge amount (which corresponds to the liquid discharge amount in FIG. 9) is small, but when the ink supply/discharge amount becomes large and the flexible films 122 and 132 bulge, sudden pressure changes occur. The negative pressure characteristics of the elastic force of the flexible films 122 and 132 change depending on factors such as the type and thickness of the film.

Figure 10:
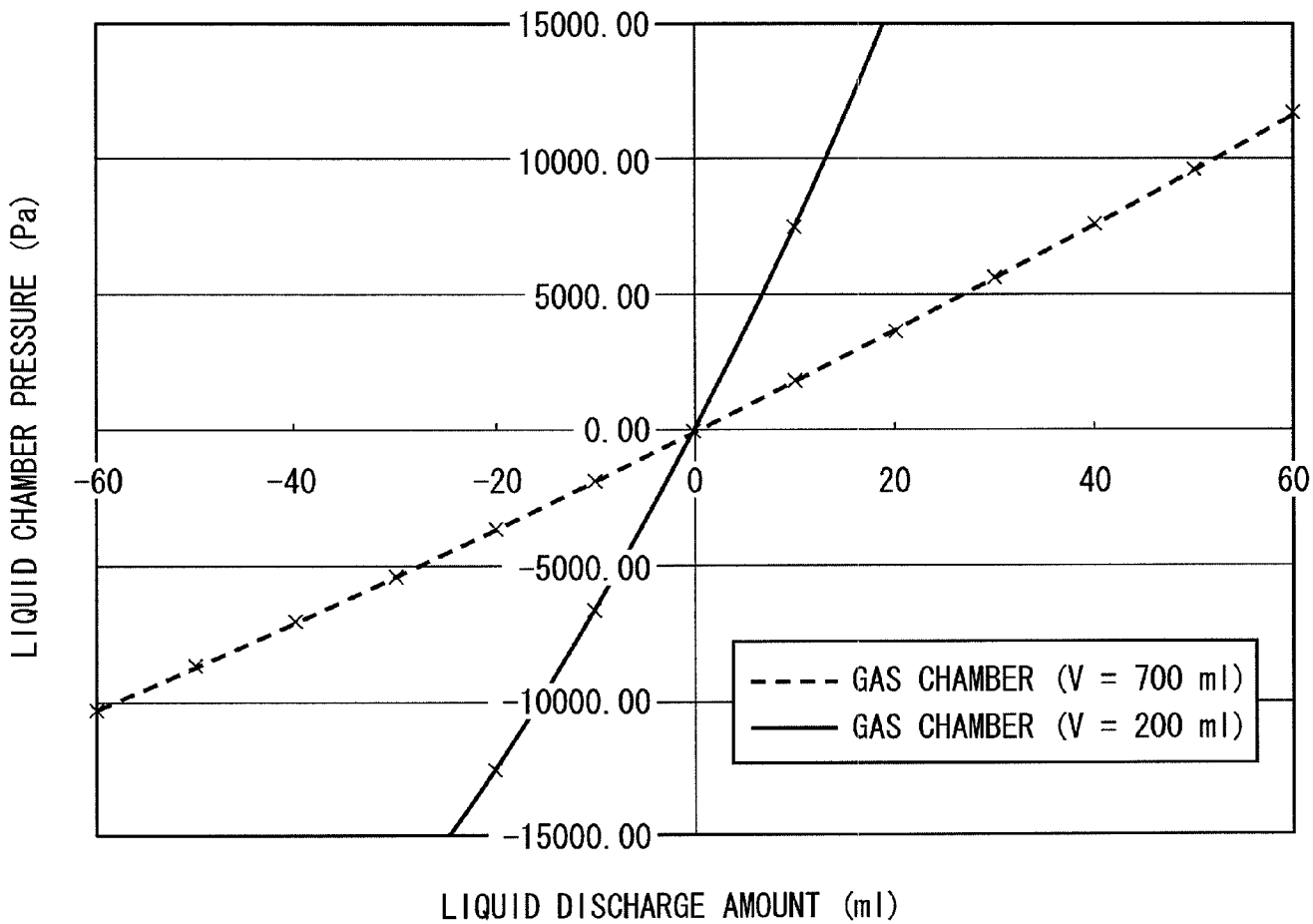
FIG. 10 is a diagram showing negative pressure characteristics of an elastic force of a gas chamber.

On the other hand, the negative pressure characteristics of the elastic force of the gas chambers 126 and 136 are maintained uniformly as shown in FIG. 9 since the multiplier of pressure and volume is constant (Boyle's Law). Then, as shown in FIG. 10, the negative pressure characteristics are uniformly set according to the capacity (volume) of the gas chambers 126 and 136.

For this reason, the negative pressure characteristics of the entire system combining the elastic force of the flexible films 122 and 132 and the elastic force of the gas chambers 126 and 136 combines the negative pressure characteristics of the elastic force of the flexible films 122 and 132 and the negative pressure characteristics of the elastic force of the gas chambers 126 and 136, which are characteristics as shown in FIG. 9. As shown in FIG. 9, when the ink supply/discharge amount (which corresponds to the liquid discharge amount in FIG. 9) is in a range of −18 ml to +20 ml, there is no pressure change in the slackness region of the flexible films 122 and 132, and therefore pressure change is produced in line with the negative pressure characteristics of the elastic force of the gas chambers 126 and 136. The amount of pressure change is approximately 2,000 Pa per 10 ml.

On the other hand, when the ink supply/discharge amount is not within the range of −18 ml to +20 ml, the flexible films 122 and 132 bulge and a sudden pressure change occurs. For example, when the ink supply/discharge amount is in a range of −40 ml to −18 ml or +20 ml to +40 ml, a sudden pressure change occurs of approximately 3,000 Pa per 10 ml, and when the ink supply/discharge amount exceeds a range of ±40 ml, and even more sudden pressure change occurs.

Here, in carrying out back pressure control by applying a predetermined back pressure (negative pressure) to the ink inside the nozzle 51 of the head 50, the ink supply/discharge amount is adjusted by controlling the driving of the first sub-pump P1 and the second sub-pump P2 after filling the ink into the liquid chambers 124 and 134 to regulate the internal pressure of the liquid chambers 124 and 134, and at this time it is preferable that the flexible films 122 and 132 do not bulge and do not produce a sudden pressure change. This is because when the flexible films 122 and 132 bulge and produce a sudden pressure change, the pressure change of the liquid chambers 124 and 134 becomes larger when the ink is discharged from the liquid chambers 124 and 134 to the head 50 for ejecting the ink from the nozzle 51, and there is a risk that stable back pressure control cannot be achieved.

Accordingly, the present invention proposes carrying out a film position initialization operation in which the state of the flexible films 122 and 132 is adjusted in advance by setting the liquid chambers 124 and 134 to a predetermined initial target pressure value (positive pressure value) prior to carrying out back pressure control.

Figure 11:
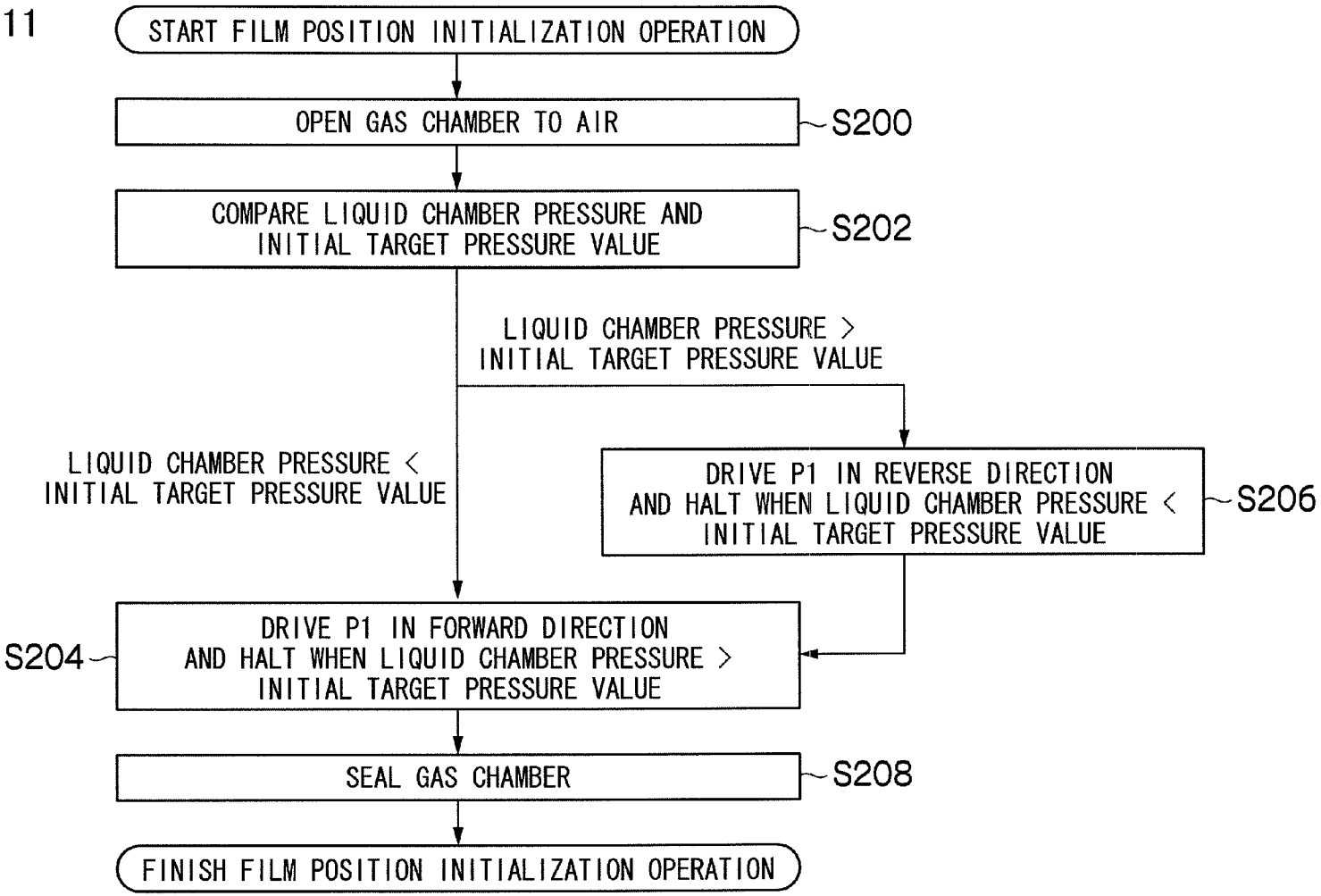
FIG. 11 is a flowchart showing a film position initialization operation.

FIG. 11 shows a flowchart of the film position initialization operation. In FIG. 11, of the supply sub-tank 120 and the recovery sub-tank 130, it is the supply sub-tank 120 that is used as a representative for description.

In FIG. 11, first, as a step S200, the air opening valve 128 is put into an open state to open the gas chamber 126 to air.

Next, as a step S202, the pressure value of the liquid chamber 124 and the initial target pressure value are compared.

More specifically, the pressure control unit 72*a* of the system controller 72 (see FIG. 6) compares the pressure value of the liquid chamber 124 determined by the pressure sensor S1 and the initial target pressure value, which is the pressure value targeted for the liquid chamber 124. Here, as is described in detail later, the initial target pressure value is a pressure value that is calculated in advance from a target value of negative pressure in back pressure control as well as the negative pressure characteristics of the elastic force of the gas chamber 126 and the negative pressure characteristics of the elastic force of the flexible film 122.

Then, in a case where the initial target pressure value is larger than the pressure value of the liquid chamber 124, the procedure proceeds to step S204, and the first sub-pump P1 is driven in the forward direction to carry out ink supply from the buffer tank 110 to the liquid chamber 124 of the supply sub-tank 120. Then, once the pressure value of the liquid chamber 124 becomes larger than the initial target pressure value, the driving of the first sub-pump P1 is halted.

On the other hand, in a case where the initial target pressure value is smaller than the pressure value of the liquid chamber 124, the procedure proceeds to step S206, and the first sub-pump P1 is driven in the reverse direction to carry out ink discharge from the liquid chamber 124 of the supply sub-tank 120 to the buffer tank 110. Then, once the pressure value of the liquid chamber 124 becomes smaller than the initial target pressure value, the driving of the first sub-pump P1 is halted. Then the procedure proceeds to step S204 and the first sub-pump P1 is driven in the forward direction to carry out ink supply from the buffer tank 110 to the liquid chamber 124 of the supply sub-tank 120. Then, once the pressure value of the liquid chamber 124 becomes larger than the initial target pressure value, the driving of the first sub-pump P1 is halted.

In this manner, since the liquid chamber 124 is set to a positive pressure of the initial target pressure value in a state in which the gas chamber 126 is open to air, the positive pressure of the liquid chamber 124 is opposed only by the elastic force of the flexible film 122.

Next, as a step S208, the air opening valve 128 is put into a closed state to seal the gas chamber 126. Thus, the flexible film 122 is put into a bulged state by setting the liquid chamber 124 in advance to the initial target pressure value, thereby completing the film position initialization operation.

Figure 12:
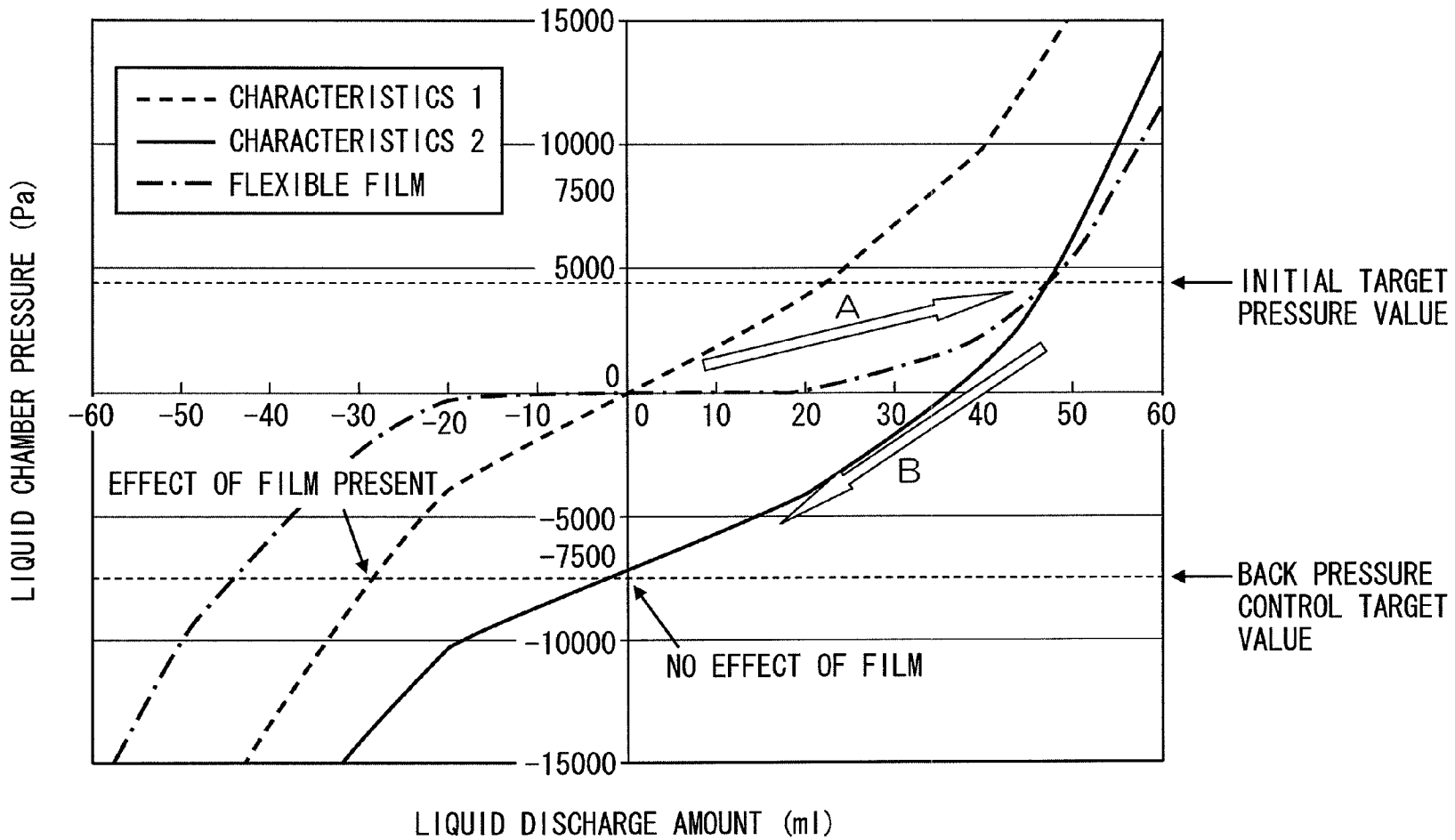
FIG. 12 is a diagram showing conditions before and after the film position initialization operation for the negative pressure characteristics of the elastic force of the flexible films, and the negative pressure characteristics of the entire system combining the elastic force of the flexible films and the elastic force of the gas chambers.

FIG. 12 is a diagram showing conditions before and after the film position initialization operation for the negative pressure characteristics of the elastic force of the flexible films 122 and 132 and the negative pressure characteristics of the entire system combining the elastic force of the flexible films 122 and 132 and the elastic force of the gas chambers 126 and 136. FIG. 12 shows a case where the target value of negative pressure (back pressure control target value) in back pressure control, in which a predetermined back pressure (negative pressure) is applied to the ink inside the nozzle 51 of the head 50, is set to −7,500 Pa.

Here, the initial target pressure value is obtained as follows. First, as shown in FIG. 12, a curve of the negative pressure characteristics of the entire system is offset from characteristics 1 to characteristics 2 so as to achieve a slackness region of the flexible films 122 and 132 (a region unaffected by the flexible films 122 and 132) with a negative pressure target value of −7,500 Pa. Then an intersection point of the curve of the characteristics 2 and a curve of the negative pressure characteristics of the elastic force of the flexible films 122 and 132 is obtained, and the pressure value of this intersection point is set as the initial target pressure value. In this manner, the initial target pressure value is a pressure value that has been calculated from the target value of negative pressure in back pressure control as well as the negative pressure characteristics of the elastic force of the gas chambers 126 and 136 and the negative pressure characteristics of the elastic force of the flexible films 122 and 132.

Description is given using FIG. 12 of a flow of control from the film position initialization operation until back pressure control.

First, as described earlier, the pressure control units 72*a* and 72*b* of the control system (see FIG. 6) calculate in advance the initial target pressure value from the target value of negative pressure in back pressure control as well as the negative pressure characteristics of the elastic force of the gas chambers 126 and 136 and the negative pressure characteristics of the elastic force of the flexible films 122 and 132. Here, it is assumed that the target value of negative pressure is set to −7,500 Pa and the initial target pressure value has been calculated as 4,500 Pa.

Next, from a state in which the pressure of the liquid chambers 124 and 134 is 0 Pa, 47 ml of the ink is supplied to the liquid chambers 124 and 134 in a state in which the gas chambers 126 and 136 are open to air through the air opening valves 128 and 138 as the film position initialization operation, and an initial target pressure value of 4,500 Pa is set. At this time, as shown by arrow A in FIG. 12, the pressure of the liquid chambers 124 and 134 rises along the curve of the negative pressure characteristics of the elastic force of the flexible films 122 and 132.

Next, in this state, the gas chambers 126 and 136 are put into sealed state and the ink is discharged from the liquid chambers 124 and 134, thereby setting the pressure of the liquid chambers 124 and 134 to the negative pressure target value of −7,500 Pa. At this time, as shown by arrow B in FIG. 12, the pressure of the liquid chambers 124 and 134 is reduced along the curve of the characteristics 2.

When this happens, the slackness region of the flexible films 122 and 132 can be achieved at the negative pressure target value of −7,500 Pa as shown in FIG. 12, and the flexible films 122 and 132 can be put into a state of slackness.

Figure 13A:
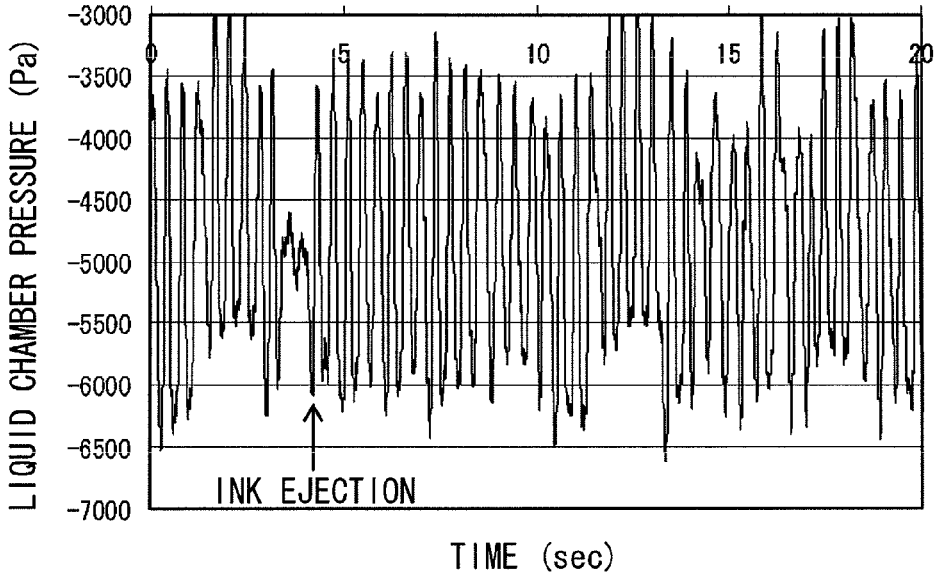
FIGS. 13A and 13B are diagrams showing pressure changes in the liquid chamber when ink is ejected at a time of back pressure control in a case where the film position initialization operation is not carried out and in a case where it is carried out.
Figure 13B:
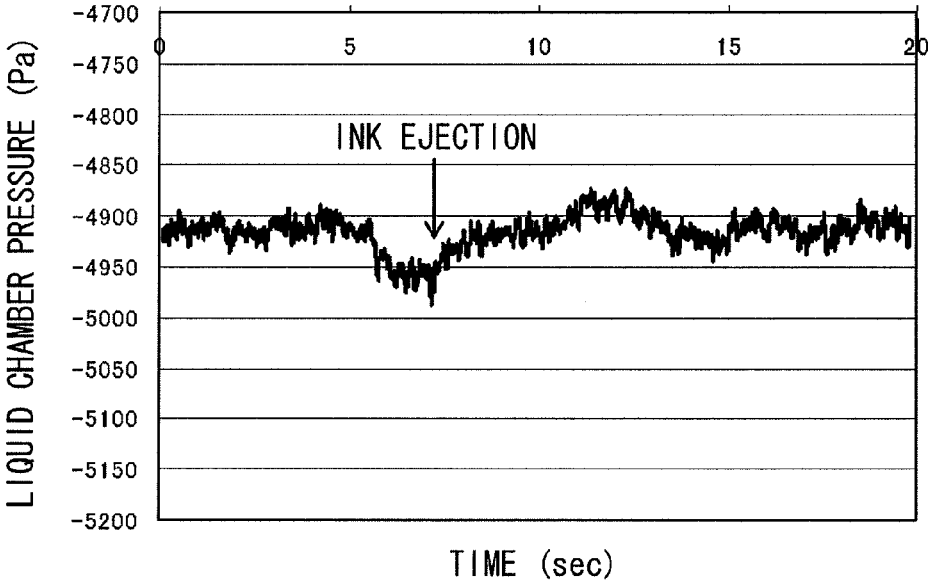

FIGS. 13A and 13B show states of pressure changes in the liquid chamber 124 of the supply sub-tank 120 when the ink is ejected at a time of back pressure control in a case where the film position initialization operation is not carried out and in a case where it is carried out.

As shown in FIG. 13A, in a case where the film position initialization operation is not carried out, pressure fluctuations are produced of a maximum range of approximately 3,500 Pa, and moreover the pressure fluctuations do not attenuate in a short time. Hence, back pressure control cannot be carried out stably.

On the other hand, as shown in FIG. 13B, in a case where the film position initialization operation is carried out, pressure fluctuations are suppressed within a maximum range of approximately 100 Pa, and moreover the pressure fluctuations attenuate in a short time. Hence, back pressure control can be carried out stably.

In the first embodiment, the flexible films 122 and 132 bulge for a predetermined supply amount or greater when the ink is supplied to the liquid chambers 124 and 134 in a state in which the gas chambers 126 and 136 are open to air, thereby causing a change in the pressure of the liquid chambers 124 and 134, and the pressure control units 72*a* and 72*b* control the pressure of the liquid chambers 124 and 134 to a predetermined value of positive pressure by supplying the ink of the predetermined supply amount or greater to the liquid chambers 124 and 134, thereby putting the flexible films 122 and 132 into a bulged state in advance, after which back pressure control is carried out, and therefore sudden pressure changes in the liquid chambers 124 and 134 due to bulging of the flexible films 122 and 132 of the supply sub-tank 120 and the recovery sub-tank 130 during back pressure control can be mitigated to enable stable back pressure control to be carried out.

As a film position initialization operation, the pressure control units 72*a* and 72*b* of the system controller 72 perform control such that the pressure of the liquid chamber 124 of the supply sub-tank 120 and the pressure of the liquid chamber 134 of the recovery sub-tank 130 become the initial target pressure value, which is obtained from the negative pressure value of the liquid chambers 124 and 134, the negative pressure characteristics of the elastic force of the flexible films 122 and 132, and the negative pressure characteristics of the elastic force of the gas chambers 126 and 136 when control is carried out of applying back pressure to the ink inside the nozzle 51 of the head 50, and therefore no influence is received of a sudden pressure change due to the flexible films 122 and 132 and back pressure control can be carried out stably.

Moreover, it is not necessary to carry out selections of devised shapes and materials for the flexible films 122 and 132, and therefore it becomes unnecessary to manage the thickness and types of the flexible films 122 and 132, which enables reduced costs to be achieved for the flexible films 122 and 132.

Further, a damping force can be applied to pressure fluctuations using the flexible films 122 and 132, and therefore it is possible to suppress pressure fluctuations in a short time.

Furthermore, the liquid chambers 124 and 134 and the gas chambers 126 and 136 are partitioned by the flexible films 122 and 132, and therefore the degassed state of the ink can be maintained, which stabilizes ejection.

Second Embodiment

Figure 14:
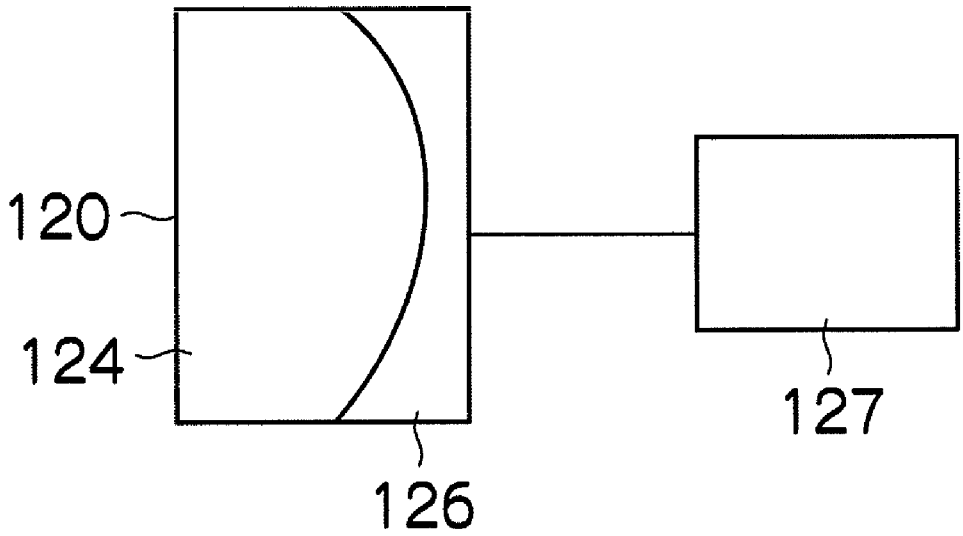
FIG. 14 is a diagram showing an arrangement of an auxiliary gas chamber.

As shown in the above-described FIG. 10, the negative pressure characteristics of the liquid chambers 124 and 134 change due to the capacity of the gas chambers 126 and 136. When there is a large ink ejection amount, control is more stable for greater capacities of the gas chambers 126 and 136. However, when the capacity of the gas chambers 126 and 136 is made larger, areas peripheral to the head 50 become larger. Consequently, as shown in FIG. 14, it is conceivable to provide auxiliary gas chambers 127 and 137 to make smaller the gas chambers 126 and 136 peripheral to the head. In FIG. 14, the supply sub-tank 120 is shown as a representative example.

In the second embodiment, by providing the auxiliary gas chambers 127 and 137, the overall capacity of the gas chambers including the gas chambers 126 and 136 becomes larger, and the negative pressure characteristics of the elastic force of the gas chambers reduces the amount of pressure change due to the ink supply/discharge amount of the liquid chambers 124 and 134. Accordingly, even for a case in which the ink ejection amount is large and the ink supply/discharge amount of the liquid chambers 124 and 134 is large, the amount of pressure change in the liquid chambers 124 and 134 becomes smaller and back pressure control can be carried out stably.

Figure 15A:
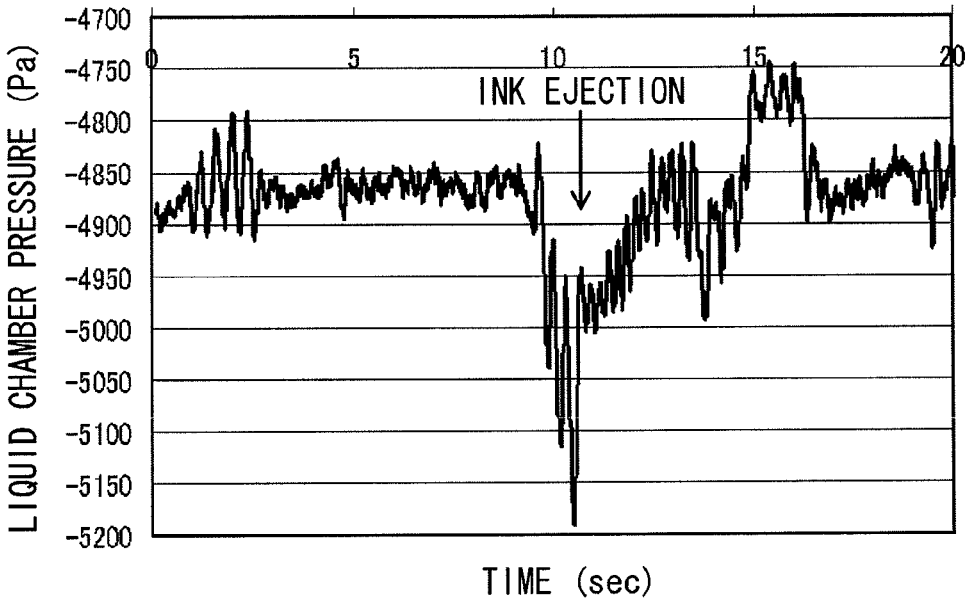
FIGS. 15A and 15B are diagrams showing pressure changes after ink ejection in a case where an auxiliary gas chamber is not provided and a case where it is provided.

As shown in FIG. 15A, in a case where the auxiliary gas chambers 127 and 137 are not provided (and when the overall capacity of the gas chamber is 300 ml each for the supply sub-tank 120 and the recovery sub-tank 130), a maximum pressure change amount of approximately 250 Pa is produced after ink ejection.

Figure 15B:
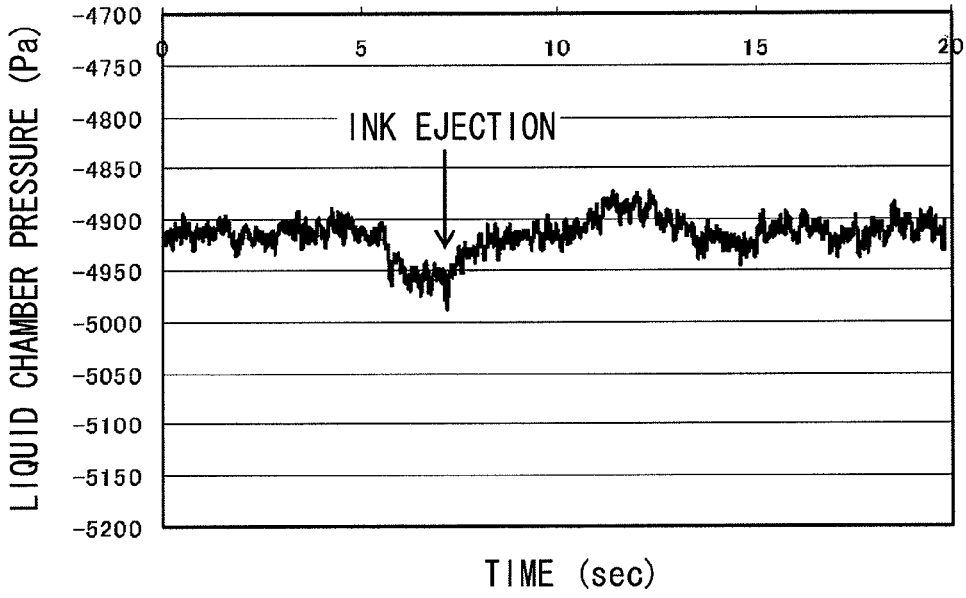

On the other hand, as shown in FIG. 15B, in a case where the auxiliary gas chambers 127 and 137 are provided (and when the overall capacity of the gas chambers is 600 ml each for the supply sub-tank 120 and the recovery sub-tank 130), the maximum pressure change amount is suppressed to approximately 75 Pa after ink ejection.

Moreover, since it is not necessary to arrange the auxiliary gas chambers 127 and 137 near the head 50, compactness around the head 50 can be achieved.

Furthermore, the capacities of the gas chamber 126 of the supply sub-tank 120 and the gas chamber 136 of the recovery sub-tank 130 can be made smaller, and therefore when applying pressure to the liquid chambers 124 and 134 to achieve a standard positive pressure value in the film position initialization operation, the flexible films 122 and 132 touch the walls of the gas chambers 126 and 136 when the flexible films 122 and 132 swell to a certain extent and thereafter do not swell further, and therefore the time of pressure application can be shortened and the durability of the flexible films 122 and 132 is also improved.

It should be noted that the configurations, operations, and effects here are otherwise in common with the first embodiment.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet recording head which includes a nozzle through which liquid is ejected;

a pressure regulating unit which includes a liquid chamber that communicates with the nozzle and a gas chamber that is partitioned from the liquid chamber by a flexible film; and a liquid chamber pressure controlling device which controls a pressure of the liquid chamber to a predetermined negative pressure when carrying out back pressure control in which back pressure is applied to the liquid inside the nozzle, wherein:

the flexible film causes change in the pressure of the liquid chamber when the liquid is supplied for at least a predetermined supply amount to the liquid chamber in a state where the gas chamber is open to air; and the liquid chamber pressure controlling device carries out the back pressure control after controlling the pressure of the liquid chamber to a predetermined value of positive pressure by supplying the liquid of at least the predetermined supply amount to the liquid chamber.

2. The inkjet recording apparatus as defined in claim 1, wherein the liquid chamber pressure controlling device controls the pressure of the liquid chamber to the predetermined value of positive pressure that is obtained from the predetermined negative pressure to be controlled as the pressure of the liquid chamber during the back pressure control, elastic characteristics of the flexible film, and elastic characteristics of the gas chamber.

3. The inkjet recording apparatus as defined in claim 1, wherein:

the recording head has a liquid supply port through which the liquid is supplied to the recording head, and a liquid discharge port through which the liquid supplied through the liquid supply port and flowing through the recording head is discharged;

the pressure regulating unit includes a first pressure regulating unit in which the liquid chamber communicates with the liquid supply port, and a second pressure regulating unit in which the liquid chamber communicates with the liquid discharge port; and the liquid chamber pressure controlling device causes the liquid supplied from the liquid supply port to be discharged from the liquid discharge port through the recording head by providing a pressure difference between the liquid chamber of the first pressure regulating unit and the liquid chamber of the second pressure regulating unit.

4. The inkjet recording apparatus as defined in claim 1, further comprising an auxiliary gas chamber which communicates with the gas chamber.

5. An inkjet recording method of carrying out back pressure control by applying back pressure to liquid inside a nozzle in an inkjet recording head by controlling a pressure of a liquid chamber of a pressure regulating unit provided with a liquid chamber that is arranged in the inkjet recording head and communicates with the nozzle through which the liquid is ejected, and a gas chamber partitioned from the liquid chamber by a flexible film, the flexible film causing change in the pressure of the liquid chamber when the liquid is supplied for at least a predetermined supply amount to the liquid chamber in a state where the gas chamber is open to air, the method comprising the steps of:

controlling the pressure of the liquid chamber to a predetermined value of positive pressure by supplying the liquid of at least the predetermined supply amount greater to the liquid chamber; and then carrying out the back pressure control.

* * * * *